US008089499B2

(12) United States Patent
Sowa et al.

(10) Patent No.: US 8,089,499 B2
(45) Date of Patent: Jan. 3, 2012

(54) EXPOSURE HEAD AND AN IMAGE FORMING APPARATUS

(75) Inventors: Takeshi Sowa, Matsumoto (JP); Yujiro Nomura, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 449 days.

(21) Appl. No.: 12/403,689

(22) Filed: Mar. 13, 2009

(65) Prior Publication Data

US 2009/0237485 A1 Sep. 24, 2009

(30) Foreign Application Priority Data

Mar. 21, 2008 (JP) ..... 2008-074116
Dec. 19, 2008 (JP) ..... 2008-323171

(51) Int. Cl.
*B41J 2/45* (2006.01)

(52) U.S. Cl. ..... 347/238; 347/233

(58) Field of Classification Search ..... 347/241, 347/243, 244, 256, 258, 238, 233; 359/619, 359/739

See application file for complete search history.

(56) References Cited

U.S. PATENT DOCUMENTS 4,435,064 A * 3/1984 Tsukada et al. ..... 355/1
6,480,219 B1 * 11/2002 Uejima et al. ..... 347/241
7,764,429 B2 * 7/2010 Nomura ..... 359/621
2007/0166077 A1 * 7/2007 Inoue et al. ..... 399/227

FOREIGN PATENT DOCUMENTS

JP 02-004546 1/1990
JP 2000-318210 * 11/2000

OTHER PUBLICATIONS

Machine Translation of JP2000-318210.*

* cited by examiner

*Primary Examiner* — Julian Huffman
*Assistant Examiner* — Sharon A Polk
(74) *Attorney, Agent, or Firm* — DLA Piper LLP (US)

(57) ABSTRACT

An exposure head, includes: a substrate that is provided with a first light emitting element, a second light emitting element that is arranged at one side of the first light emitting element in a first direction and a third light emitting element that is arranged at the one side of the second light emitting element in the first direction, the first light emitting element and the second light emitting element being arranged at a first distance from each other in the first direction, the second light emitting element and the third light emitting element being arranged at a second distance, which is different from the first distance, from each other in the first direction; and an imaging optical system that images light from the first, the second and the third light emitting elements.

6 Claims, 29 Drawing Sheets

FIG. 13

UNIT: mm

| SURFACE NUMBER | R (CURVATURE RADIUS) | d (SURFACE INTERVAL) | nd (REFRACTIVE INDEX) | vd (ABBE CONSTANT) | K (ASPHERICAL COEFFICIENT) |
|---|---|---|---|---|---|
| S1 (OBJECT PLANE) | R1= ∞ | d1= 1.0000 | | | |
| S2 (APERTURE) | R2= ∞ | d2= 0.3000 | | | |
| S3 (ASPHERICAL SURFACE) | R3= 0.47176 | d3= 0.5000 | nd3= 1.5168 | vd3= 64.2 | K3=−2.47216 |
| S4 | R4= ∞ | d4= 1.0000 | | | |
| S5 (ASPHERICAL SURFACE) | R5= 1.52587 | d5= 0.5000 | nd5= 1.5168 | vd5= 64.2 | |
| S6 | R6= ∞ | d6= 0.9039 | | | |
| S7 (IMAGE PLANE) | R7= ∞ | | | | |

DEFINITIONAL EQUATION OF ASPHERICAL SURFACE ···

$$\frac{cr^2}{1+\sqrt{1-(1+K)c^2r^2}}$$

r···DISTANCE FROM OPTICAL AXIS
c···CURVATURE ON OPTICAL AXIS (=1/R)
K···CONIC CONSTANT

FIG. 14

OPTICAL DATA

| | |
|---|---|
| WAVELENGTH | 685.5[nm] |
| NUMERICAL APERTURE ON OBJECT SIDE | 0.1 |
| MAGNIFICATION ON OPTICAL AXIS | −1.53 |

FIG. 21

UNIT: mm

| SURFACE NUMBER | R(CURVATURE RADIUS) | d(SURFACE INTERVAL) | nd (REFRACTIVE INDEX) | vd(ABBE CONSTANT) | K(ASPHERICAL COEFFICIENT) |
|---|---|---|---|---|---|
| S1 (OBJECT PLANE) | R1= ∞ | d1= 0.8000 | | | |
| S2 (ASPHERICAL SURFACE) | R2= 0.49479 | d2= 0.5000 | nd2= 1.5168 | vd2= 64.2 | K2=−1.72836 |
| S3 | R3= ∞ | d3= 0.1000 | | | |
| S4 (APERTURE) | R4= ∞ | d4= 0.6628 | | | |
| S5 (ASPHERICAL SURFACE) | R5= 0.60505 | d5= 0.5000 | nd5= 1.5168 | vd5= 64.2 | K5=−1.50907 |
| S6 | R6= ∞ | d6= 1.1330 | | | |
| S7 (IMAGE PLANE) | R7= ∞ | | | | |

DEFINITIONAL EQUATION OF ASPHERICAL SURFACE ···

$$\frac{cr^2}{1+\sqrt{1-(1+K)c^2r^2}}$$

r···DISTANCE FROM OPTICAL AXIS
c···CURVATURE ON OPTICAL AXIS(=1/R)
K···CONIC CONSTANT

FIG. 22

OPTICAL DATA

| | |
|---|---|
| WAVELENGTH | 685.5[nm] |
| NUMERICAL APERTURE ON OBJECT SIDE | 0.1 |
| MAGNIFICATION ON OPTICAL AXIS | −1.49 |

EXPOSURE HEAD AND AN IMAGE FORMING APPARATUS

CROSS REFERENCE TO RELATED APPLICATION

The disclosure of Japanese Patent Applications No. 2008-74116 filed on Mar. 21, 2008 and No. 2008-323171 filed on Dec. 19, 2008 including specification, drawings and claims is incorporated herein by reference in its entirety.

BACKGROUND

1. Technical Field

This invention relates to an exposure head that images lights emitted from light emitting elements and an image forming apparatus using the exposure head.

2. Related Art

A line head in which a plurality of optical lens systems (imaging optical systems) are arranged as disclosed, for example, in JP-A-2-4546 is known as such an exposure head. A plurality of light emitting dots (light emitting elements) are grouped and arranged to face the respective optical lens systems. These plurality of light emitting dots are arranged in a specified direction (first direction), and a plurality of spots are formed in the specified direction (first direction) when light beams emitted from the respective light emitting dots are imaged by the optical lens systems. A latent image is formed in a part exposed by these spots.

SUMMARY

In the above line head, a plurality of light emitting elements are arranged in the first direction for one imaging optical system and the respective light emitting elements have different positional relationships with the imaging optical system. Accordingly, if the imaging optical system has a distortion, a plurality of spots, which should be formed at equal pitches in the first direction, cannot be formed at equal pitches, whereby the pitches in the first direction have varied in some cases.

In addition to the above problem, the following problem has occurred in some cases. Specifically, light emitting elements generate heat when being driven for light emission. Accordingly, heat is likely to accumulate near the center of the plurality of light emitting elements (in other words, near the center of gravity of the plurality of light emitting elements) and the thermal deterioration of the light emitting elements arranged near the center tended to accelerate. As a result, there have been cases where a degree of thermal deterioration differs among the respective light emitting elements and good latent image formation (spot formation) cannot be performed.

An advantage of some aspects of the invention is to enable good spot formation by suppressing the influence of the above distortion of the imaging optical system on spot formation and/or to enable good spot formation by suppressing the above differences in the degree of thermal deterioration.

According to a first aspect of the invention, there is provided an exposure head, comprising: a substrate that is provided with a first light emitting element, a second light emitting element that is arranged at one side of the first light emitting element in a first direction and a third light emitting element that is arranged at the one side of the second light emitting element in the first direction, the first light emitting element and the second light emitting element being arranged at a first distance from each other in the first direction, the second light emitting element and the third light emitting element being arranged at a second distance, which is different from the first distance, from each other in the first direction; and an imaging optical system that images light from the first, the second and the third light emitting elements.

According to a second aspect of the invention, there is provided an image forming apparatus, comprising: a latent image carrier that carries a latent image; and an exposure head that includes a substrate that is provided with a first light emitting element, a second light emitting element that is arranged at one side of the first light emitting element in a first direction and a third light emitting element that is arranged at the one side of the second light emitting element in the first direction, the first light emitting element and the second light emitting element being arranged at a first distance from each other in the first direction, the second light emitting element and the third light emitting element being arranged at a second distance, which is different from the first distance, from each other in the first direction, and an imaging optical system that images light from the first, the second and the third light emitting elements.

In the invention (exposure head, image forming apparatus) constructed as above, the substrate is provided with the first light emitting element, the second light emitting element arranged at the one side of the first light emitting element in the first direction and the third light emitting element arranged at the one side of the second light emitting element in the first direction. The first light emitting element and the second light emitting element are arranged at the first distance from each other in the first direction, and the second light emitting element and the third light emitting element are arranged at the second distance, which is different from the first distance, from each other in the first direction. In other words, the distance between the first and the second light emitting elements in the first direction and the distance between the second and the third light emitting elements in the first direction are different. Thus, as described later, it is possible to enable good spot formation by suppressing the influence of a distortion of an imaging optical system on spot formation or to enable good spot formation by suppressing differences in the degree of thermal deterioration among the above light emitting elements.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 13 is a table showing lens data of the imaging optical system according to the first embodiment.

FIG. 14 is a table showing an optical system specification of the imaging optical system according to the first embodiment.

FIG. 21 is a table showing lens data of the imaging optical system according to the second embodiment.

FIG. 22 is a table showing an optical system specification of the imaging optical system according to the second embodiment.

DESCRIPTION OF EXEMPLARY EMBODIMENTS

First of all, basic constructions of a line head, to which the invention is applicable, and an image forming apparatus including the line head are described below. Following the description of the basic constructions, embodiments of the invention are described.

Basic Structure

Figure 1:
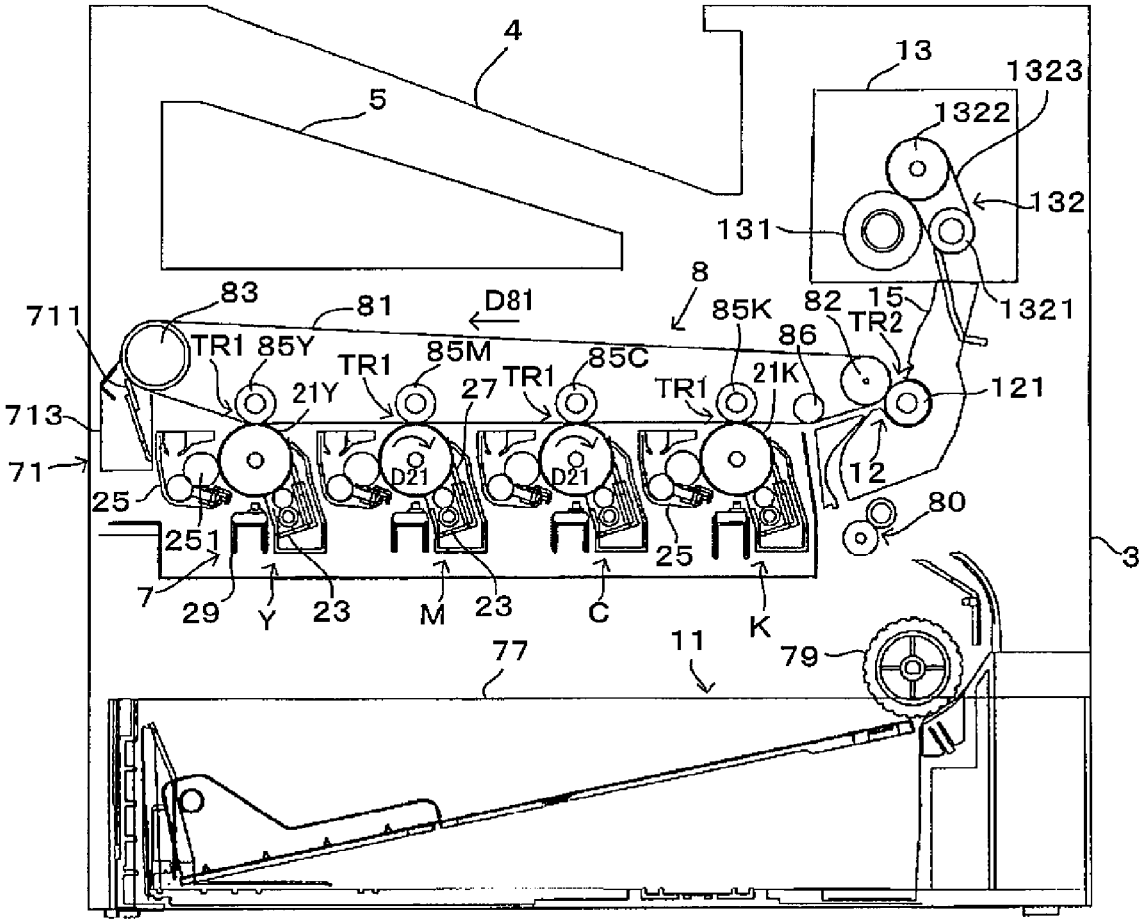
FIG. 1 is a diagram showing an embodiment of an image forming apparatus including a line head as an application subject of the invention.
Figure 2:
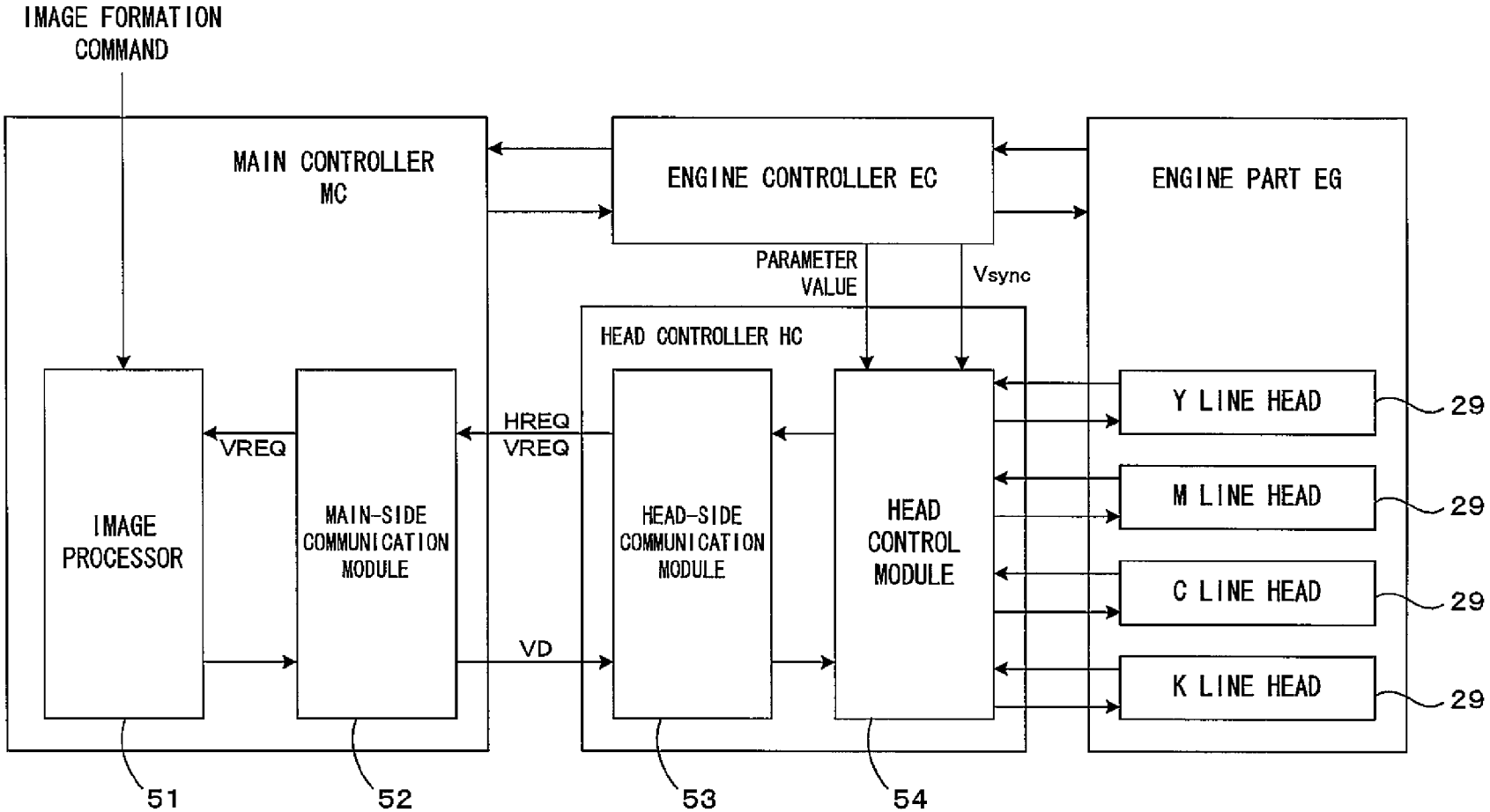
FIG. 2 is a diagram showing the electrical construction of the image forming apparatus of FIG. 1.

FIG. 1 is a diagram showing an embodiment of an image forming apparatus including a line head as an application subject of the invention. FIG. 2 is a diagram showing the electrical construction of the image forming apparatus of FIG. 1. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 1 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus. An image forming unit 7, a transfer belt unit 8 and a sheet feeding unit 11 are also arranged in the housing main body 3. A secondary transfer unit 12, a fixing unit 13 and a sheet guiding member 15 are arranged at the right side in the housing main body 3 in FIG. 1. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y, M, C and K includes a cylindrical photosensitive drum 21 having a surface of a specified length in a main scanning direction MD. Each of the image forming stations Y, M, C and K forms a toner image of the corresponding color on the surface of the photosensitive drum 21. The photosensitive drum is arranged so that the axial direction thereof is substantially parallel to the main scanning direction MD. Each photosensitive drum 21 is connected to its own driving motor and is driven to rotate at a specified speed in a direction of arrow D21 in FIG. 1, whereby the surface of the photosensitive drum 21 is transported in the sub scanning direction SD which is orthogonal to or substantially orthogonal to the main scanning direction MO. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 1.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 is arranged relative to the photosensitive drum 21 so that the longitudinal direction thereof corresponds to the main scanning direction MD and the width direction thereof corresponds to the sub scanning direction SD. Hence, the longitudinal direction of the line head 29 is substantially parallel to the main scanning direction MD. The line head 29 includes a plurality of light emitting elements arrayed in the longitudinal direction and is positioned separated from the photosensitive drum 21. Light beams are emitted from these light emitting elements toward the surface of the photosensitive drum 21 charged by the charger 23, thereby forming an electrostatic latent image on this surface.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the electrostatic latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 1, and the transfer belt 81 mounted on these rollers and driven to rotate in a direction (transporting direction) of arrow D81 shown in FIG. 1. The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator (not shown). As described in detail later, at the time of executing the color mode, all the primary transfer rollers 85Y, 85M, 85C and 85K are positioned on the sides of the image forming stations Y, M, C and K as shown in FIG. 1, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85V, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713.

Figure 3:
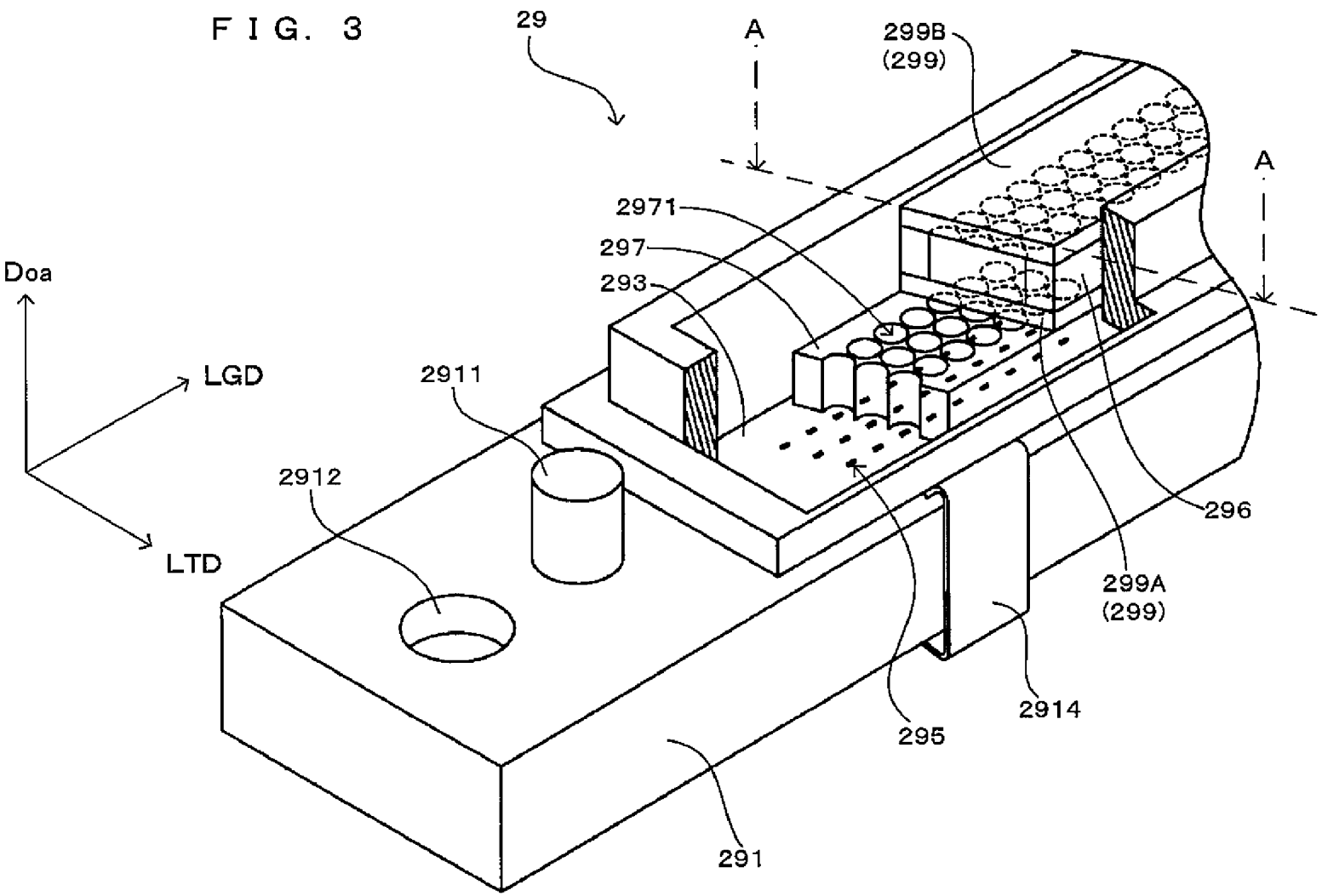
FIG. 3 is a perspective view schematically showing a line head according to the invention.
Figure 4:
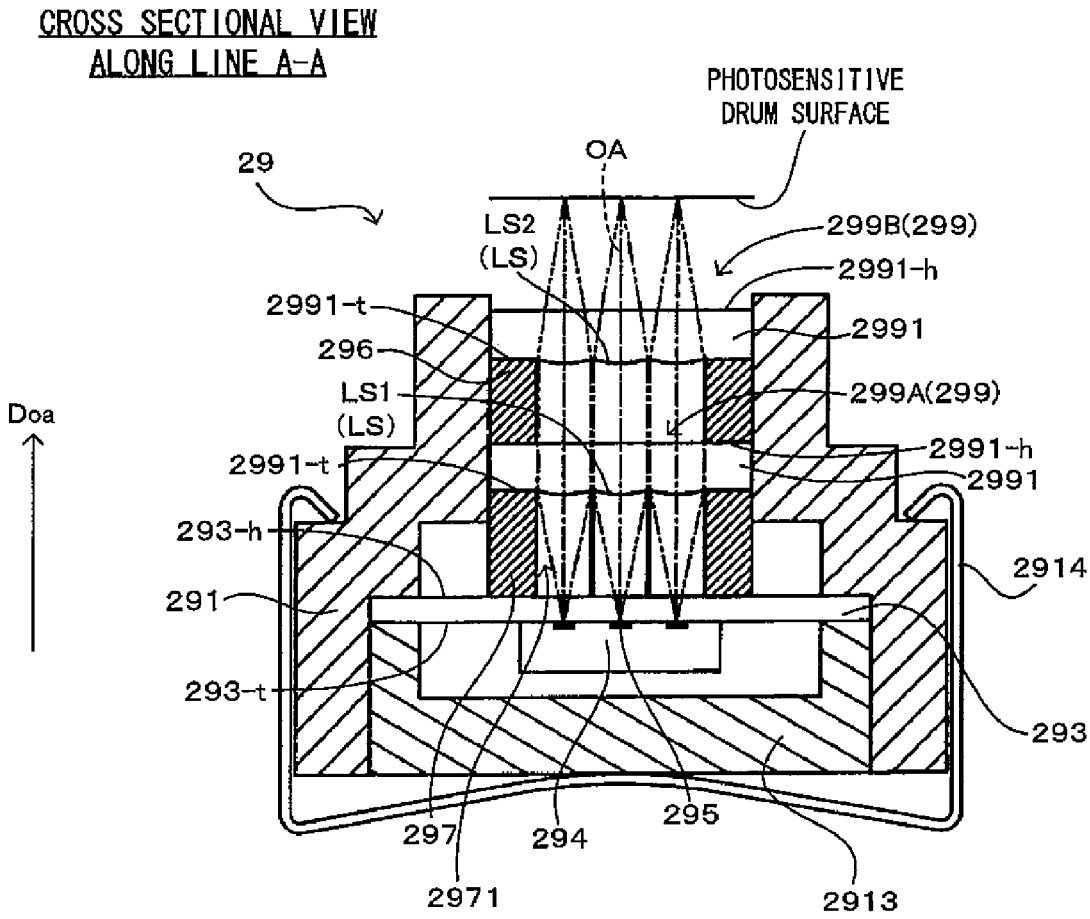
FIG. 4 is a partial sectional view of a line head shown in FIG. 3 taken on line A-A, the cross section being parallel to the optical axis of the lens.

FIG. 3 is a perspective view schematically showing a line head according to the invention, and FIG. 4 is a partial sectional view of a line head shown in FIG. 3 taken on line A-A, the cross section being parallel to the optical axis of the lens. The line A-A is parallel to or approximately parallel to a light emitting element group column 295C or a lens column LSC described later. As described above, the line head 29 is arranged relative to the photosensitive drum 21 such that the longitudinal direction LGD thereof corresponds to the main scanning direction M and the width direction LTD thereof corresponds to the sub scanning direction SD. That is, the longitudinal direction LGD is parallel to or approximately parallel to the main scanning direction MD, and the width direction LTD is parallel to or approximately parallel to the sub scanning direction SD. The longitudinal direction LGD and the width direction LTD are orthogonal to or approximately orthogonal to each other. As described later, in this line head 29, a plurality of light emitting elements are formed on the head substrate 293 and the respective light emitting elements emit light beams toward the surface of the photosensitive drum 21. Accordingly, in this specification, a direction orthogonal to the longitudinal direction LGD and to the width direction LTD and propagating from the light emitting elements toward the photosensitive drum surface is referred to as a light beam propagation direction Doa. This light beam propagation direction Doa is parallel to or approximately parallel to optical axes OA to be described later.

The line head 29 includes a case 291, and a positioning pin 2911 and a screw insertion hole 2912 are provided at each of the opposite ends of such a case 291 in the longitudinal direction LGD. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The head substrate 293, a light shielding member 297 and two lens arrays 299 (299A, 299B) are arranged in the case 291. The inner side of the case 291 is held in contact with a top surface 293-*h* of the head substrate 293, whereas an under lid 2913 is held in contact with an under surface 293-*t* of the head substrate 293. This under lid 2913 is pressed against the inner side of the case 291 via the head substrate 293 by fixing devices 2914. In other words, the fixing devices 2914 have elastic forces for pressing the under lid 2913 toward the inner side (upper side in FIG. 4) of the case 291 and the interior of the case 291 is light-tightly sealed (in other words, so that light does not leak from the interior of the case 291 and light does not enter the case 291 from the outside) by the under lid being pressed by such elastic forces. The fixing devices 2914 are provided at a plurality of positions in the longitudinal direction LGD of the case 291.

The light emitting element groups 295 formed by grouping a plurality of light emitting elements are provided on the under surface 293-*t* of the head substrate 293. The head substrate 293 is made of a light transmissive material such as glass, and light beams emitted from the respective light emitting elements of the light emitting element groups 295 can transmit from the under surface 293-*t* of the head substrate 293 to the top surface 293-*h* thereof. These light emitting elements are bottom emission-type organic EL (electro-luminescence) devices and are covered by a sealing member 294.

Figure 5:
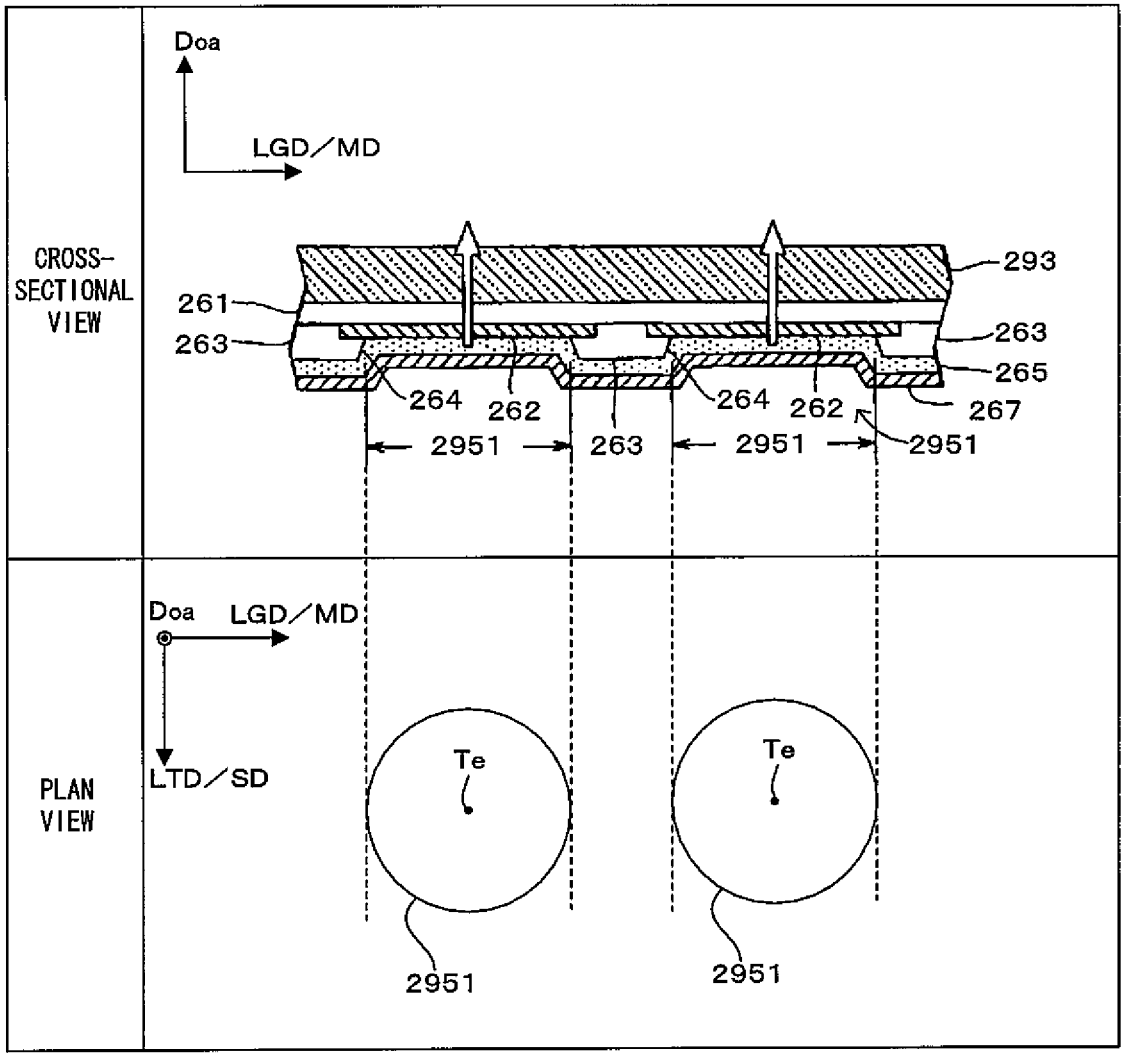
FIG. 5 is a diagram showing the structure of the light emitting elements.

FIG. 5 is a diagram showing the structure of the light emitting elements, wherein a partial sectional view ("Cross-Sectional View" in an upper part of FIG. 5) showing a vertical structure of the light emitting elements and a plan view ("Plan View" in a lower part of FIG. 5) showing a planar structure of the light emitting elements are shown one above the other. As shown in FIG. 5, a wiring layer 261 is formed on the under surface of the head substrate 293. Although not shown, the wiring layer 261 is formed by laminating electrical conductive layers and insulating layers. The electrical conductive layers are layers including active elements (transistors) for controlling the light quantities of the light emitting elements 2951 and wiring for transmitting various signals. The insulating layers are so laminated as to electrically insulate the respective electrical conductive layers. First electrodes 262 are formed on the outer surface of the wiring layer. The first electrodes 262 are made of a light transmissive and conductive material such as ITO (indium tin oxide) and function as anodes of the light emitting elements 2951.

An insulating layer 263 is so formed as to be laminated on the wiring layer 261 and the first electrodes 262. The insulating layer 263 is an insulating film body. This insulating layer 263 is formed with apertures 264 in areas overlapping the first electrodes 262 when seen in the light propagation direction Doa. These apertures 264 are formed for the respective first electrodes 262 as holes penetrating the insulating layer 263 in a thickness direction. The first electrodes 262 and the insulating layer 263 are covered by a light emitting layer 265 made of an organic EL material. The light emitting layer 265 is continuously formed over a plurality of light emitting elements 2951 by a deposition technique such as a spin coating method. Although the light emitting layer 265 is continuously formed over the plurality of light emitting elements 2951, the first electrodes 262 are independently formed for the respective light emitting elements 2951. Accordingly, the light quantities of the light emitting elements 2951 are individually controlled for the respective light emitting elements 2951 in accordance with currents supplied from the first electrodes 262. However, the light emitting layer 265 may be formed for each light emitting element 2951 by a printing technique such as a droplet discharge method (an ink-jet method).

A second electrode 267 is so formed as to be laminated on the light emitting layer 265. The second electrode 267 is a light reflective conductive film and continuously formed over the plurality of light emitting elements 2951. In this way, the light emitting layer 265 is vertically sandwiched between the first electrodes 262 and the second electrode 267 and emits lights at intensities corresponding to drive currents flowing from the first electrodes 262 to the second electrode 267. Lights emitted from the light emitting layer 265 toward the first electrodes 262 and those reflected by the surface of the second electrode 267 pass through the first electrodes 262 and the head substrate 293 to be emitted to imaging optical systems to be described later as shown by white outline arrows of FIG. 5. Since no currents flow in areas between the first electrodes 262 and the second electrode 267 where the insulating layer 263 is located, parts of the light emitting layer 265 overlapping the insulating layer 263 do not emit lights. In other words, as shown in FIG. 5, out of a laminated structure made up of the first electrodes 262, the light emitting layer 265 and the second electrode 267, parts located inside the apertures 264 function as the light emitting elements 2951. Accordingly, the positions and configurations (sizes, forms) of the light emitting elements 2951 when seen from above in the light propagation direction Doa are determined according to the positions and configurations of the apertures 264 (see the part "Plan View" of FIG. 5). Thus, in the drawings of this specification, the light emitting elements 2951 when seen from above in the light propagation direction Doa are expressed by the apertures 264. In this specification, an expression "the position of the light emitting element 2951" is used if necessary. The position Te of the light emitting element 2951 is the center of gravity of the light emitting element 2951 (aperture 264) when viewed from above.

In this specification, an expression "a distance between the light emitting elements" is used if necessary. The distance between the light emitting elements is a distance between the centers of gravity of the light emitting elements. Further, in this specification, the "center of gravity" means "geometric center of gravity".

The respective light emitting elements 2951 formed on the head substrate 293 in this way emit light beams having an equal wavelength. The light emitting elements 2951 are so-called perfectly diffusing surface illuminants and the light beams emitted from the light emitting surfaces comply with Lambert's cosine law.

Figure 6:
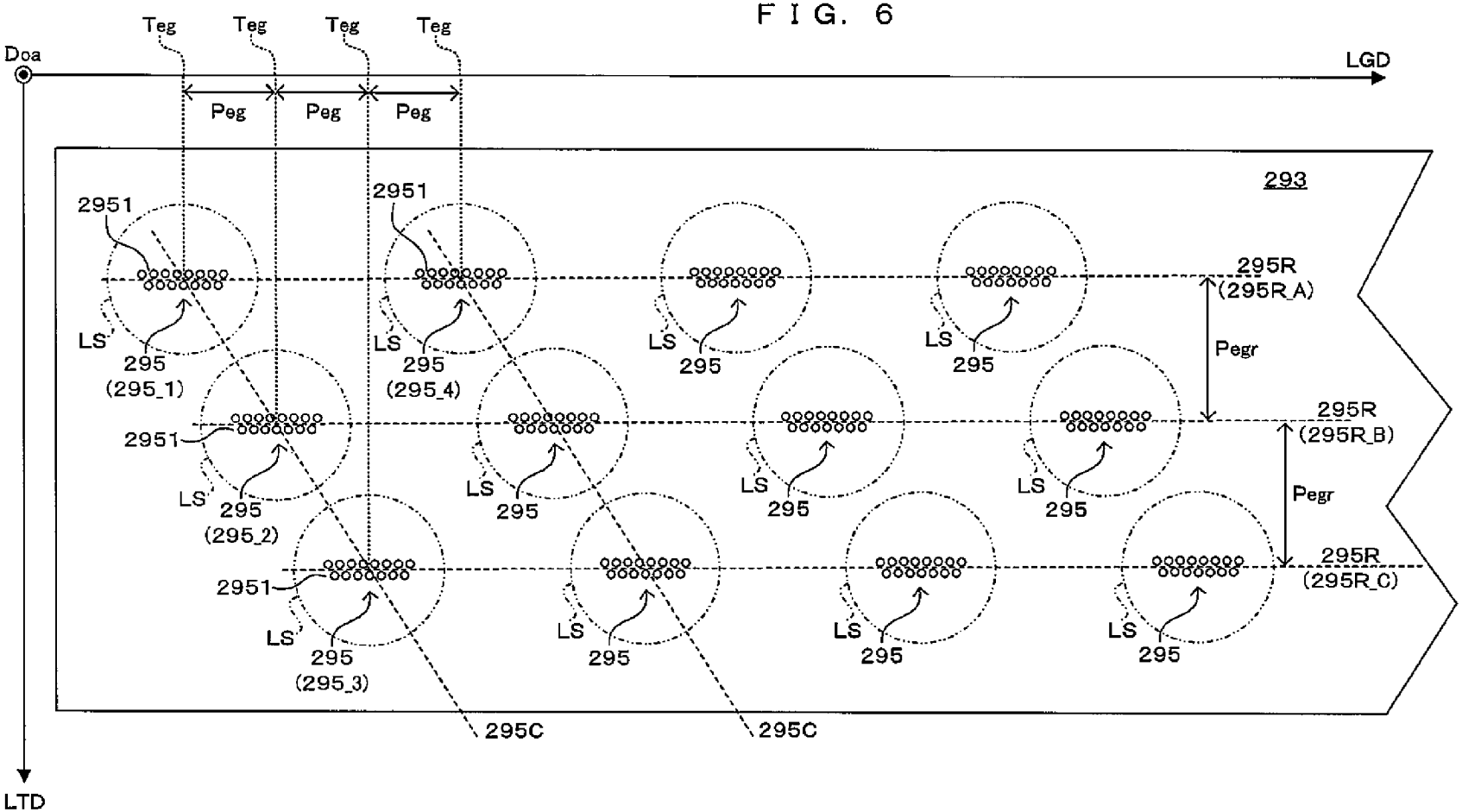
FIG. 6 is a plan view showing the construction of the under surface of the head substrate.

FIG. 6 is a plan view showing the construction of the under surface of the head substrate and corresponds to a case where the under surface of the head substrate is seen from the top surface thereof. In FIG. 6, the lenses LS are shown by chain double-dashed line to show that the light emitting element groups 295 are provided in a one-to-one correspondence with the lenses LS, but not to show that the lenses LS are arranged on the under surface 293-*t* of the head substrate. As shown in FIG. 6, fifteen light emitting elements are grouped to form one light emitting element group 295, and a plurality of light emitting element groups 295 are arranged on the under surface 293-*t* of the head substrate 293. As shown in FIG. 6, a plurality of light emitting element groups 295 are two-dimensionally arranged on the head substrate 293. The details are as follows.

Three light emitting element groups 295 are arranged at positions mutually different in the width direction LTD to form a light emitting element group column 295C. In each light emitting element group column 295C, three light emitting element groups 295 are displaced from each other by the light emitting element group pitch Peg in the longitudinal direction LGD. A plurality of light emitting element group columns 295C are arranged at the light emitting element group column pitches (=Peg×3) in the longitudinal direction LGD. Thus, the respective light emitting element groups 295 are arranged at the light emitting element group pitches Peg in the longitudinal direction LGD, and the positions Teg of the respective light emitting element groups 295 in the longitudinal direction LGD differ from each other.

From another point of view, it can also be said that the light emitting element groups 295 are arranged as follows. Specifically, on the under surface 293-*t* of the head substrate 293, a plurality of light emitting element groups 295 are aligned in the longitudinal direction LGD to form a light emitting element group row 295R, and three light emitting element group rows 295R are arranged at positions different from each other in the width direction LTD. These three light emitting element group rows 295R are arranged at the light emitting element group row pitches Pegr in the width direction LTD. Further, the respective light emitting element group rows 295R are displaced from each other by the light emitting element group pitches Peg in the longitudinal direction LGD. Accordingly, a plurality of the light emitting element groups 295 are arranged at the light emitting element group pitches Peg in the longitudinal direction LGD, and the positions Teg of the respective light emitting element groups 295 in the longitudinal direction LGD differ from each other.

Here, the position of the light emitting element group 295 can be obtained as a center of gravity of the light emitting element group 295 when seen in the light propagation direction Doa. The center of gravity of the light emitting element group 295 can be obtained as a center of gravity of a plurality of light emitting elements 2951 constituting the light emitting element group 295 when the light emitting elements 2951 are seen in the light propagation direction Doa. Further, the light emitting element group pitch Peg can be obtained as an interval between the respective positions Teg in the longitudinal direction LGD of two light emitting element groups 295 (for example, light emitting element groups 295_1, 295_2) whose positions Teg are adjacent in the longitudinal direction LGD. In FIG. 6, the positions Teg of the light emitting element groups 295 in the longitudinal direction LGD are indicated by feet of perpendiculars to an axis of the longitudinal direction LGD from the positions of the light emitting element groups 295.

Referring back to FIGS. 3 and 4, description continues. The light shielding member 297 is arranged in contact with the top surface 293-*h* of the head substrate 293. The light shielding member 297 is provided with light guide holes 2971 for the respective plurality of light emitting element groups 295. In other words, a plurality of light guide holes 2971 are formed in a one-to-one correspondence with the plurality of light emitting element groups 295. The light guide holes 2971 are formed as holes penetrating the light shielding member 297 in the light beam propagation direction Doa. Further, two lens arrays 299 are arranged side by side in the light beam propagation direction Doa above the light shielding member 297 (at a side opposite to the head substrate 293).

As described above, the light shielding member 297 provided with the light guide holes 2971 for the respective light emitting element groups 295 is arranged between the light emitting element groups 295 and the lens arrays 299 in the light beam propagation direction Doa. Accordingly, light beams emitted from the light emitting element groups 295 propagate toward the lens arrays 299 through the light guide holes 2971 corresponding to the light emitting element groups 295. Conversely speaking, out of the light beams emitted from the light emitting element groups 295, those propagating toward other than the light guide holes 2971 corresponding to the light emitting element groups 295 are shielded by the light shielding member 297. In this way, all the lights emitted from one light emitting element group 295 propagate toward the lens arrays 299 via the same light guide hole 2971 and the mutual interference of the light beams emitted from different light emitting element groups 295 is prevented by the light shielding member 297.

Figure 7:
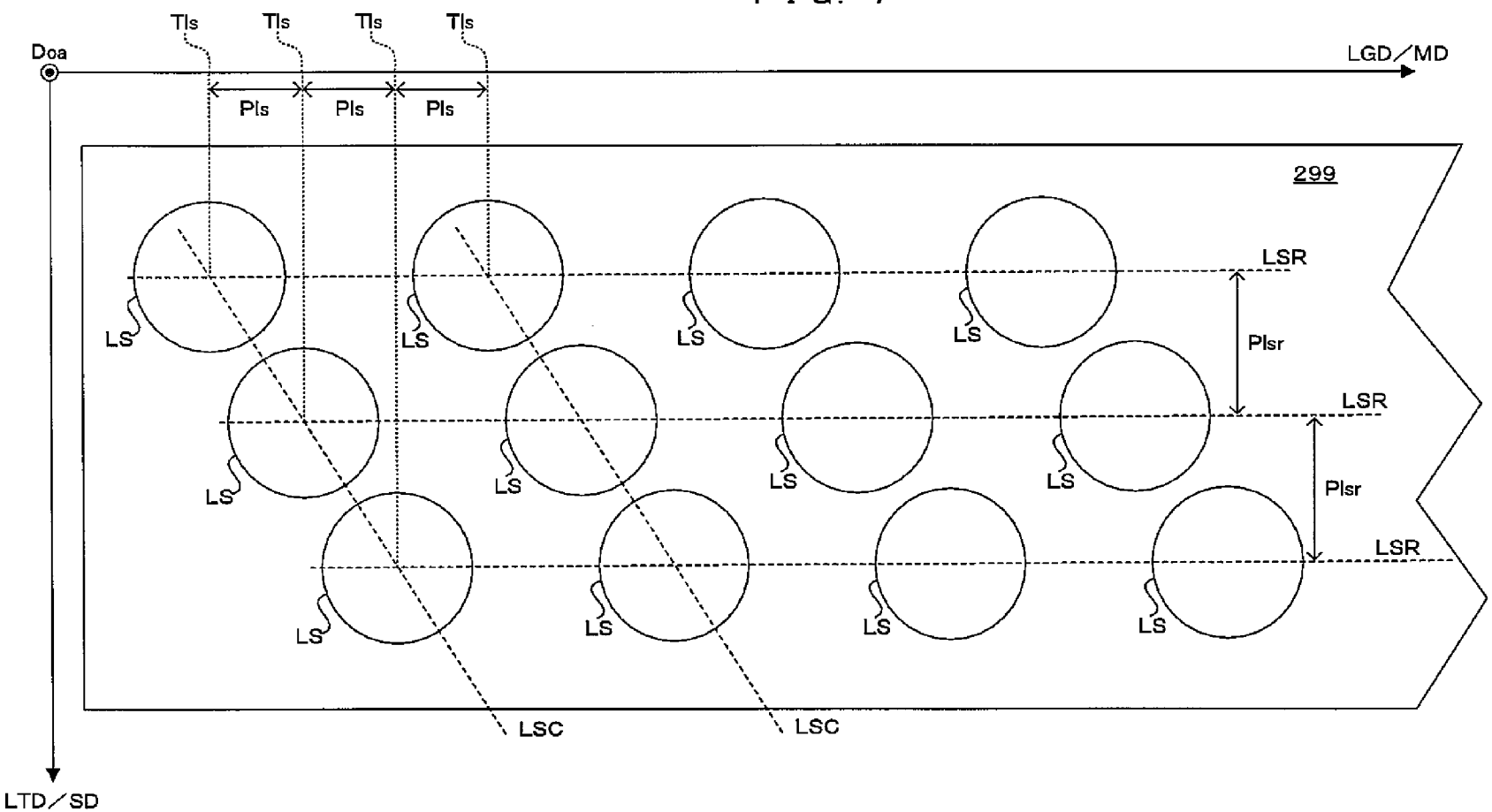
FIG. 7 is a plan view showing a structure of the lens array.

FIG. 7 is a plan view showing a structure of the lens array and corresponds to a case where the lens array is seen from an image plane side (from a side of the light beam propagation direction Doa). The respective lenses LS in FIG. 7 are formed on an under surface 2991-*t* of a lens array substrate 2991 and the construction of this lens array substrate under surface 2991-*t* is shown in FIG. 7. As shown in FIG. 6 and other figures, one lens LS is provided for each light emitting element group 295 in the lens array 299. In other words, the plurality of lenses LS are two-dimensionally arranged in the respective lens arrays 299. The details are as follows.

Three lenses LS are arranged at mutually different positions in the width direction LTD to form a lens column LSC. In each lens column LSC, three lenses LS are displaced from each other by the lens pitch Pls in the longitudinal direction LGD. A plurality of lens columns LSC are arranged in the longitudinal direction LGD at the lens column pitch (=Pls×3). Thus, the respective lenses LS are arranged in the longitudinal direction LGD at the lens pitch Pls, and the positions Tls of the respective lenses LS in the longitudinal direction LGD differ from each other.

From another point of view, it can also be said that the lenses LS are arranged as follows. Specifically, a plurality of lenses LS are aligned in the longitudinal direction LGD to form a lens row LSR, and three lens rows LSR are arranged at positions different from each other in the width direction LTD. These three lens rows LSR are arranged at the lens row pitches Plsr in the width direction LTD. Further, the respective lens rows LSR are displaced from each other by the lens pitches Pls in the longitudinal direction LGD. Accordingly, the plurality of lenses LS are arranged in the longitudinal direction LGD at the lens pitches Pls, and the positions Tls of the respective lenses LS in the longitudinal direction LGD differ from each other.

In FIG. 7, the positions of the lenses LS are represented by the tops of the lenses LS (that is, points where sag is maximum) and the positions Tls of the lenses LS in the longitudinal direction LGD are represented by feet of perpendiculars to the axis in the longitudinal direction LGD from the tops of the lenses LS.

Figure 8:
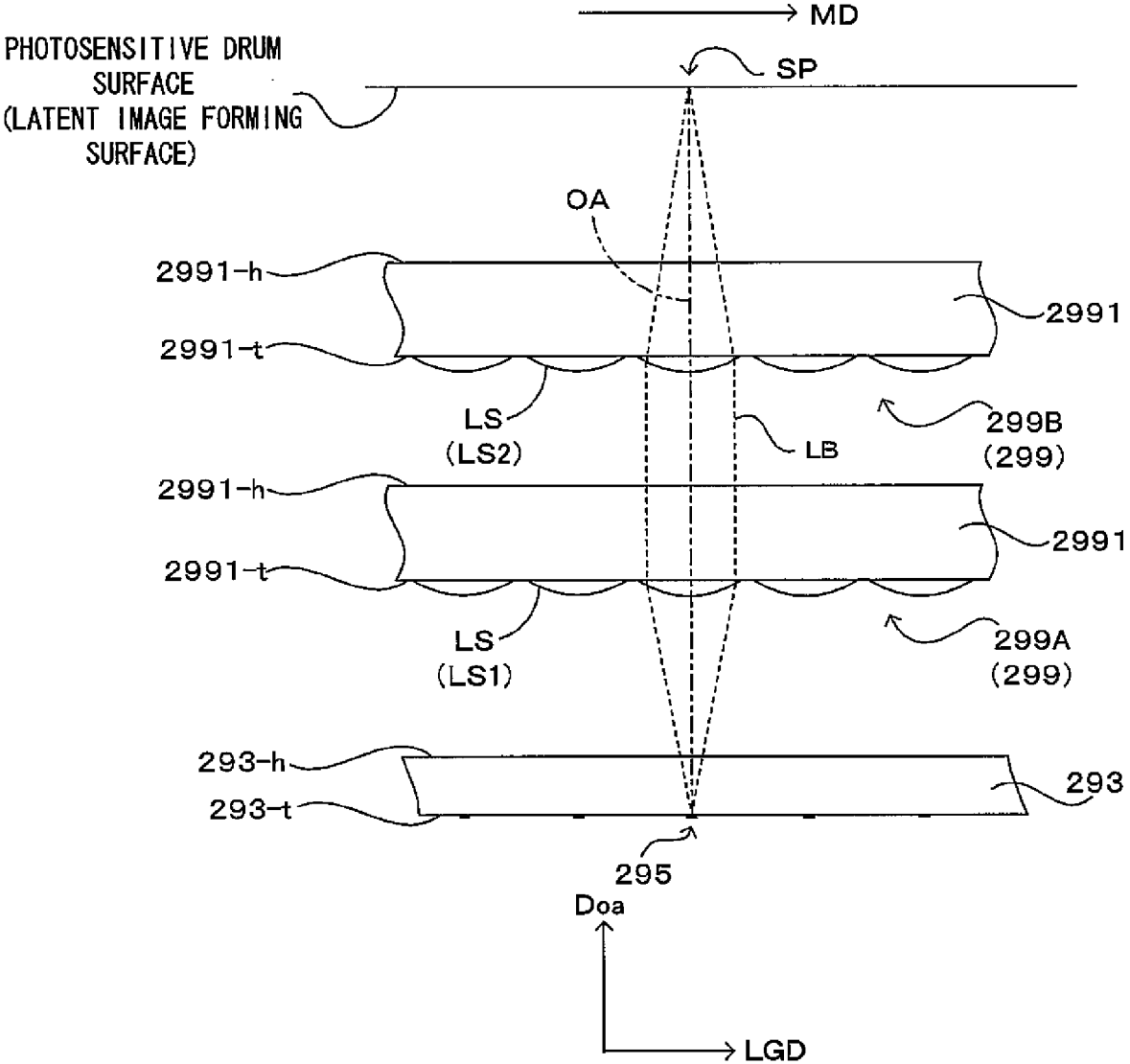
FIG. 8 is a longitudinal sectional view of the lens arrays, the head substrate and the like showing a longitudinal cross section including an optical axis of the lens formed in the lens array.

FIG. 8 is a longitudinal sectional view of the lens arrays, the head substrate and the like showing a longitudinal cross section including an optical axis of the lens LS formed in the lens array. The lens array 299 includes the light transmissive lens array substrate 2991 long in the longitudinal direction LGD. This lens array substrate 2991 is made of a glass having a relatively small linear expansion coefficient. Out of a top surface 2991-*h* and the under surface 2991-*t* of the lens array substrate 2991, the lenses LS are formed on the under surface 2991-*t* of the lens array substrate 2991. The lenses LS may be formed by a light curing resin for instance.

In this line head 29, in order to increase a degree of freedom in optical design, two lens arrays 299 (299A, 299B) having such a configuration are arranged side by side in the light beam propagation direction Doa. These two lens arrays 299A, 299B are opposed to each other with a pedestal 296 located therebetween (FIGS. 3 and 4), and this pedestal 296 fulfills a function of specifying the spacing between the lens arrays 299A, 299B. Thus, two lenses LS1, LS2 aligned in the light beam propagation direction Doa are arranged for each light emitting element group 295 (FIGS. 3, 4 and 8). Here, the lens LS of the lens array 299A upstream in the light beam propagation direction Doa is the first lens LS1, and that of the lens array 299B downstream in the light beam propagation direction Doa is the second lens LS2.

Light beams LB emitted from the light emitting element group 295 are imaged by the two lenses LS1, LS2 arranged to face this light emitting element group 295 to form spots SP on the photosensitive drum surface (latent image forming surface). In other words, an imaging optical system is formed by the two lenses LS1, LS2 and this imaging optical system is arranged to face each light emitting element group 295. An optical axis OA of the imaging optical system is parallel to the light propagation direction Doa and passes through the center of gravity position of the light emitting element group 295. This imaging optical system has a so-called inverting and enlarging optical characteristic. In other words, the imaging optical system forms an inverted image and the absolute value of the optical magnification of the imaging optical system is larger than 1.

Figure 9:
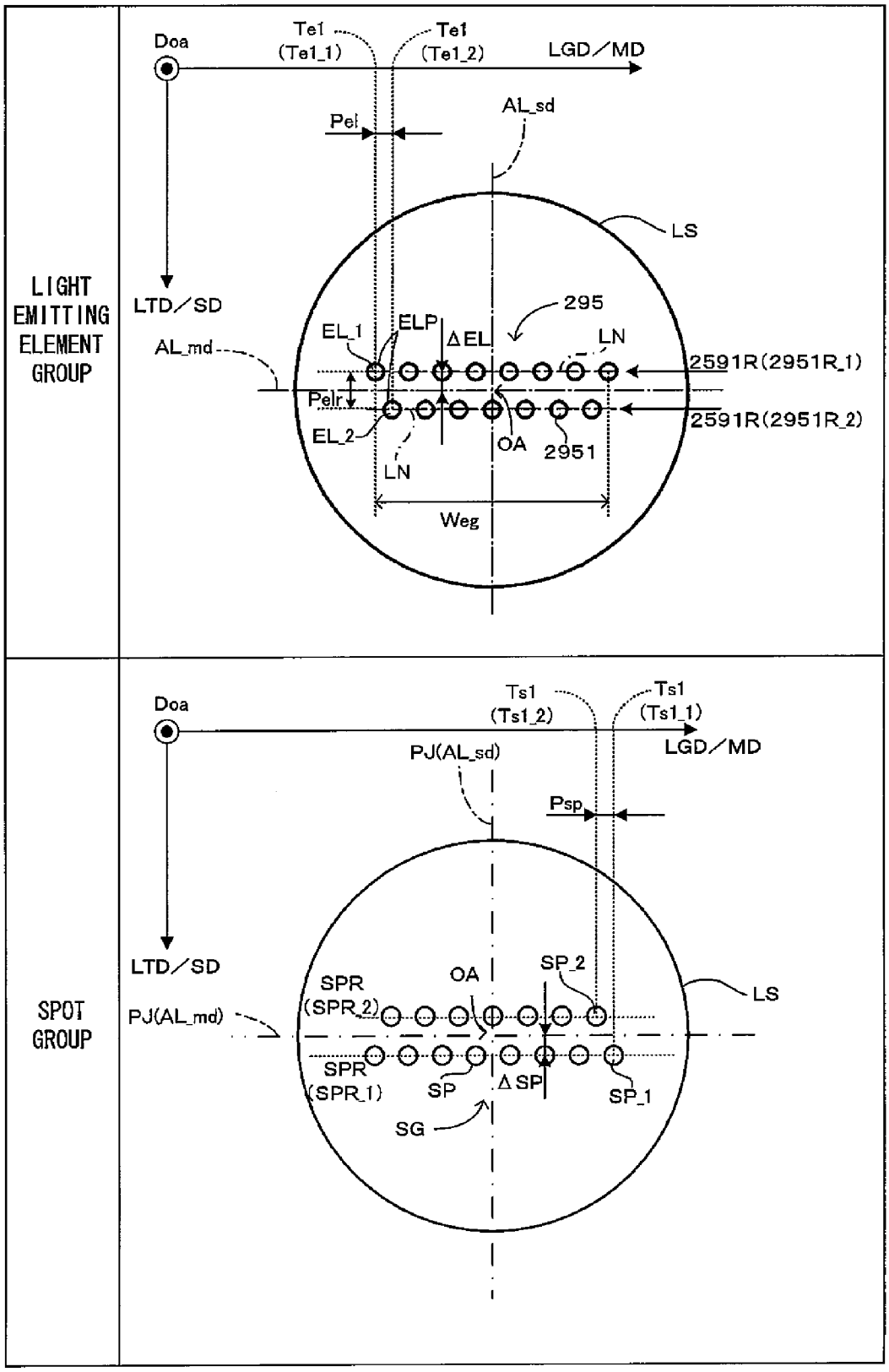
FIG. 9 is a plan view showing the configuration of the light emitting element group and a spot forming operation by this light emitting element group.

FIG. 9 is a plan view showing the configuration of the light emitting element group and a spot forming operation by this light emitting element group. First of all, the configuration of the light emitting element group is described with reference to the section "Light Emitting Element Group" of FIG. 9. In this section, a first straight line AL_md is a straight line passing the optical axis OA and parallel to the main scanning direction MD, and a second straight line AL_sd is a straight line passing the optical axis OA and parallel to the sub scanning direction SD. These first and second straight lines AL_md, AL_sd are assumed to be located on the head substrate under surface 293-*t* where the light emitting elements 2951 are formed.

In the light emitting element group 295, fifteen light emitting elements 2951 are arranged at the light emitting element pitches Pel at positions different from each other in the longitudinal direction LGD. The light emitting element pitch Pel is a pitch (for example, equivalent to a distance between main-direction positions Tel_1 and Tel_2) in the longitudinal direction LGD (main scanning direction MD) between two light emitting elements 2951 (for example, light emitting elements EL_1, EL_2) whose main-direction positions Tel are adjacent. In FIG. 9, the main-direction position Tel is indicated by a foot of a perpendicular to an axis of the longitudinal direction LGD (main scanning direction MN) from the position Te of the target light emitting element 2951. In this specification, a pair of two light emitting elements 2951 whose main-direction positions Tel are in an adjacent relationship and which are arranged at the light emitting element pitch Pel in the longitudinal direction LGD like the light emitting elements EL_1, EL_2 are called an "adjacent light emitting element pair ELP". In FIG. 9, in the respective adjacent light emitting element pairs ELP, the two light emitting elements 2951 constituting each adjacent light emitting element pair ELP are arranged at the equal light emitting element pitch Pel.

This light emitting element group 295 is arranged to form light emitting element rows 2951R. Each light emitting element row 2951R is formed by arranging two or more light emitting elements 2951 at different positions in the longitudinal direction LGD. More specifically, a light emitting element row 2951R_1 is formed by arranging eight light emitting elements 2951 at pitches, which are twice the light emitting element pitch Pel, in the longitudinal direction LGD, and a light emitting element row 2951R_2 is formed by arranging seven light emitting elements 2951 at pitches, which are twice the light emitting element pitch Pel, in the longitudinal direction LGD.

In each light emitting element row 2951R, a plurality of light emitting elements 2951 are linearly arranged. In this section, alignment lines LN (virtual lines) are also shown to show such arrangement modes of the light emitting elements 2951. In other words, the plurality of light emitting elements 2951 are arranged at the same position in the width direction LTD in each light emitting element row 2951R. Accordingly, as illustrated using the light emitting element row 2951R_1, a distance ΔEL (sub-direction element to optical axis distance ΔEL) in the width direction LTD between the light emitting elements 2951 and the first straight line AL_md is equal among the respective light emitting elements 2951. The sub-direction element to optical axis distance ΔEL can be obtained as a distance in the width direction LTD between the positions Te of the light emitting elements 2951 and the first straight line AL_md.

These light emitting element rows 2951R_1, 2951R_2 are arranged at a light emitting element row pitch Pelr in the width direction LTD or arranged at positions different from each other in the width direction LTD. In addition, the light emitting element rows 2951R_1, 2951_2 are displaced from each other by the light emitting element pitch Pel in the longitudinal direction LGD. In this way, fifteen light emitting elements 2951 are two-dimensionally arranged in the light emitting element group 295. Further, the respective light emitting elements 2951 are arranged at the light emitting element pitches Pel at positions different from each other in the longitudinal direction LGD. Furthermore, two light emitting elements 2951 arranged at the light emitting element pitch Pel in the longitudinal direction LGD are displaced from each other by the light emitting element row pitch Pelr in the width direction LTD.

The thus configured light emitting element group 295 has a light emitting element group width Weg=(15−1)×Pel. Here, the light emitting element group width Weg is a distance between the positions Te of the light emitting elements 2951 located at the opposite ends of the light emitting element group 295 in the longitudinal direction LGD. The light emitting element group 295 is symmetrically arranged with respect to the second straight line AL_sd.

Next, the spot forming operation by the light emitting element group is described with reference to the section "Spot Group" of FIG. 9. In this section, a first projected straight line PJ (AL_md) is a projected straight line of the first straight line AL_md on the photosensitive drum surface in the light propagation direction Doa, and a second projected straight line PJ (AL_sd) is a projected straight line of the second straight line AL_sd on the photosensitive drum surface in the light propagation direction Doa.

Lights emitted from the respective light emitting elements 2951 of the light emitting element row 2951R_1 are imaged in an inverted manner by the imaging optical system to form a spot row SPR_1. This spot row SPR_1 is an array of eight spots SP arranged at pitches, which are twice the spot pitch Psp, in the main scanning direction MD. Further, lights emitted from the respective light emitting elements 2951 of the light emitting element row 2951R_2 are imaged in an inverted manner by the imaging optical system to form a spot row SPR_2. This spot row SPR_2 is an array of seven spots SP arranged at pitches, which are twice the spot pitch Psp, in the main scanning direction MD. In this way, the respective light emitting element rows 2951R can form spot rows SPR, in each of which a plurality of spots SP are arranged in the main scanning direction MD, by simultaneously driving the plurality of light emitting elements 2951.

Further, in each spot row SPR, the plurality of spots SP are arranged at the same position in the sub scanning direction SD. Accordingly, as illustrated using the spot row SPR_1, a distance ΔSP (sub-direction spot to optical axis distance ΔSP) in the sub scanning direction SD between the spots SP and the first projected straight line PJ (AL_md) is equal among the respective light emitting elements 2951. The sub-direction spot to optical axis distance ΔSP can be obtained as a distance in the sub scanning direction SD between the centers of gravity of the spots SP and the first projected straight line PJ (AL_md).

These spot rows SPR_1, SPR_2 are formed at positions different from each other in the sub scanning direction SD. In addition, the respective spot rows SPR_1, SPR_2 are displaced from each other at the spot pitch Psp in the longitudinal direction LGD. In this way, a spot group SG is formed in which fifteen spots SP are two-dimensionally arranged, and the respective spots SP are formed at the spot pitches Psp at positions different from each other in the main scanning direction MD in this spot group SG. In other words, spots SP_1, SP_2 arranged at the spot pitch Psp in the main scanning direction MD are, for example, formed by the light emitting elements EL1, EL2 constituting the adjacent light emitting element pair. This section corresponds to a case where the imaging optical system has no distortion, and the respective spots SP are formed at equal spot pitches Psp in the main scanning direction MD. The spot pitch Psp is a pitch in the main scanning direction MD between two spots (for example, spots SP_1, SP_2) whose main-direction positions Ts1 are adjacent (for example, corresponds to a distance between the main-direction positions Ts1_1 and Ts1_2). In FIG. 9, the main-direction position Ts1 is indicated by a foot of a perpendicular to an axis of the main scanning direction MD from the center of gravity of the target spot.

Figure 10:
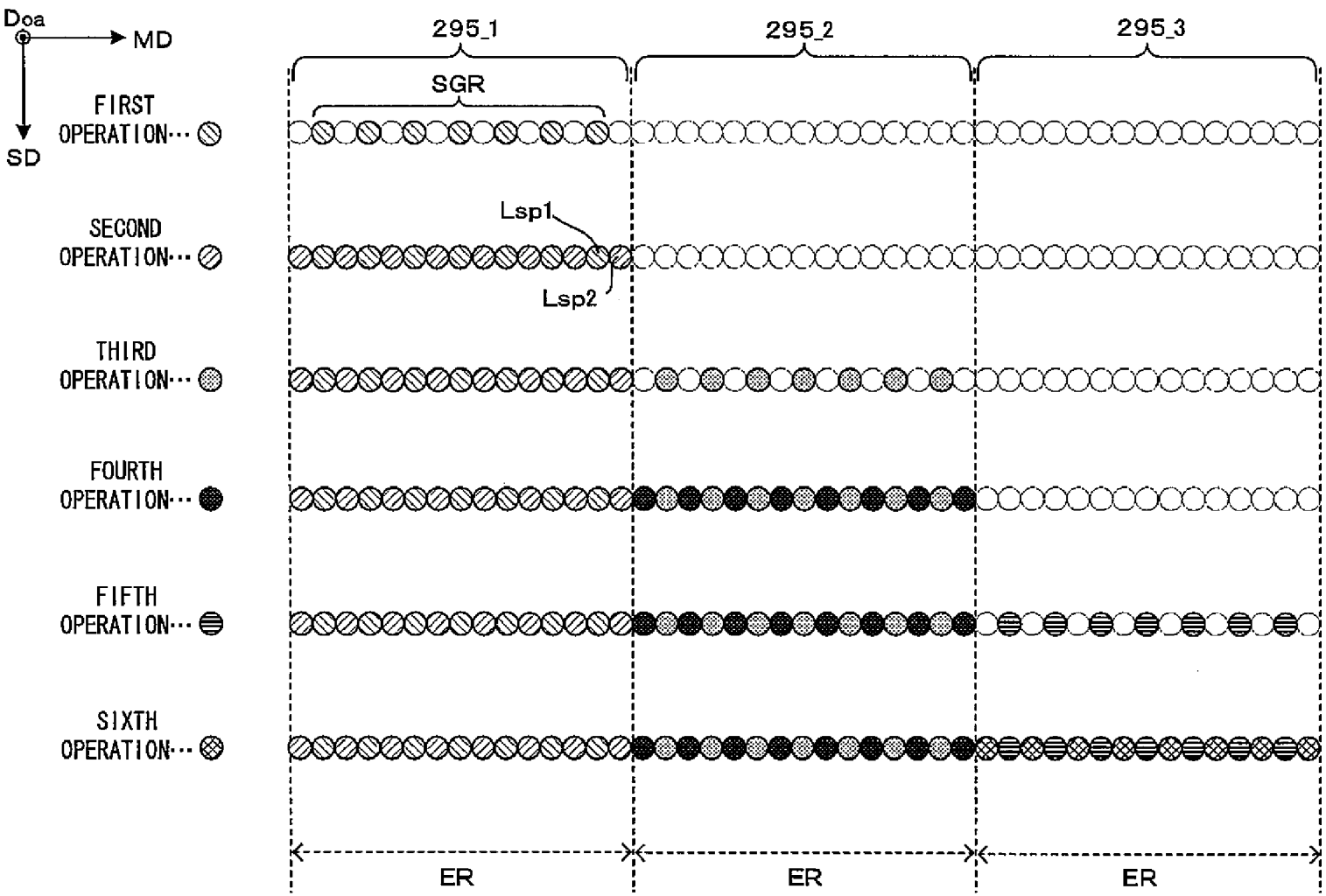
FIG. 10 is a diagram showing a spot latent image forming operation by the line head.

As described above, a plurality of light emitting element groups 295 are two-dimensionally arranged in the line head 29. A latent image forming operation by the line head 29 is performed by controlling the light emissions of the respective light emitting element groups 295 as described below. FIG. 10 is a diagram showing a spot latent image forming operation by the line head. The spot latent image forming operation by the line head is described below with reference to FIGS. 6, 9 and 10. Roughly, the respective light emitting element groups 295 perform latent image formation by forming spots in mutually different exposure regions ER. In such a latent image forming operation, a plurality of spots SP are formed side by side in the main scanning direction MD by driving the respective light emitting elements 2951 for light emission at specified timings by the head control module 54 while the surface of the photosensitive drum 21 is conveyed in the sub scanning direction SD. This is described in detail below.

First of all, when the light emitting element rows 2951R_2 of the light emitting element groups 295 (295_1, 295_4, etc.) belonging to the most upstream light emitting element group row 295R_A in the width direction LTD are driven for light emission, spot rows SPR are formed. In this way, a region where the respective spots SP are formed is exposed to form seven spot latent images shown by hatching in a "First Operation" of FIG. 10. In FIG. 10, white circles represent spot latent images that are not formed yet, but planned to be formed later. In FIG. 10, spots labeled by reference numerals 295_1, 295_2, 295_3 are spot latent images to be formed by the light emitting element groups 295 corresponding to the respective attached reference numerals.

Each light emitting element row 2951R_1 is driven for light emission following the light emitting element rows 2951R_2 to form eight spot latent images shown by hatching in a "Second Operation" of FIG. 10. In this way, two light emitting elements 2951 arranged at the light emitting element pitch Pel in the longitudinal direction LGD can form two spot latent images (for example, spot latent images Lsp1, Lsp2) adjacent in the main scanning direction MD. Here, the light emitting element rows 2951R are successively driven for light emission from the one downstream in the width direction LTD in order to deal with the inversion characteristic the imaging optical system has.

Next, the light emitting element groups 295 (295_2, etc.) belonging to the light emitting element group rows 295R_B downstream of the light emitting element group row 295R_A in the width direction LTD are driven for light emission similar to the above light emitting element group row 295R_A, whereby spot latent images shown by hatching in a "Third Operation" to a "Fourth Operation" of FIG. 10 are formed. Further, the light emitting element groups 295 (295_3, etc.) belonging to the light emitting element group row 295R_C downstream of the light emitting element group row 295R_B in the width direction LTD are driven for light emission similar to the above light emitting element group row 295R_A, whereby spot latent images shown by hatching in a "Fifth Operation" to a "Sixth Operation" of FIG. 10 are formed. By performing the first to sixth light emitting operations in this way, a plurality of spot latent images are formed while being arranged in the main scanning direction MD.

First Embodiment

The above basic constructions assume that the imaging optical systems have no distortions. However, it is actually difficult to fabricate imaging optical systems free from distortions and the imaging optical systems have specific distortions.

Figure 11:
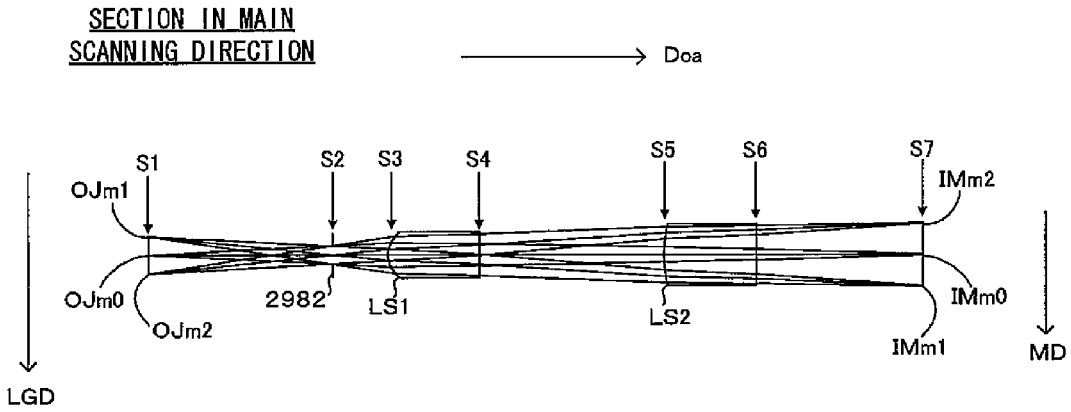
FIG. 11 is a sectional view in the main scanning direction of an imaging optical system according to a first embodiment.
Figure 12:
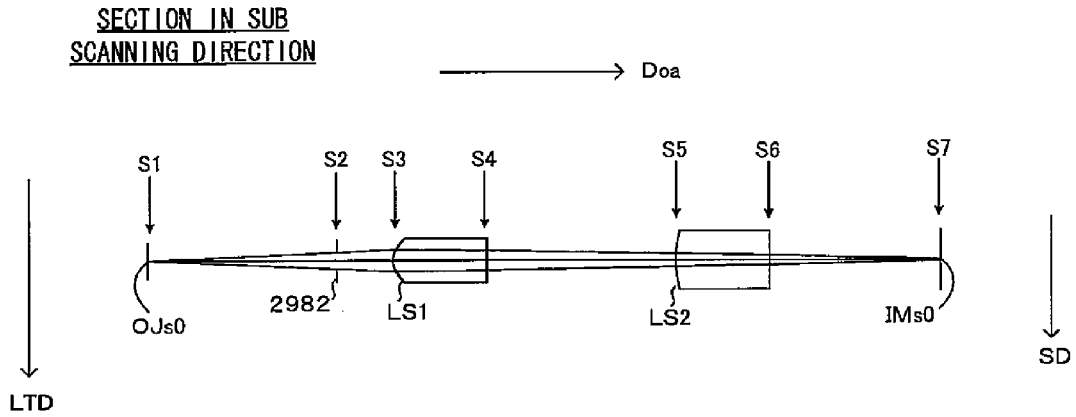
FIG. 12 is a sectional view in the sub scanning direction of the imaging optical system according to the first embodiment.

FIG. 11 is a sectional view in the main scanning direction of an imaging optical system according to a first embodiment. FIG. 12 is a sectional view in the sub scanning direction of the imaging optical system according to the first embodiment. FIG. 13 is a table showing lens data of the imaging optical system according to the first embodiment. FIG. 14 is a table showing an optical system specification of the imaging optical system according to the first embodiment. As can be understood from FIGS. 11 to 13, a first lens LS1 and a second lens LS2 are both aspherical lenses. Further, a diaphragm 2982 is arranged between an object plane S1 and an aspherical surface S3 (first lens LS1).

In FIG. 11, an object point OJm0 is located on an optical axis OA and light emitted from the object point OJm0 is imaged as an image IMm0 on the optical axis OA. Lights emitted from object points OJm1, OJm2 deviated from the optical axis OA are imaged as images IMm1, IMn2 in an inverted manner. Further, as shown in FIG. 12, light emitted from an object point OJs0 on the optical axis OA is imaged as an image IMs0 on the optical axis OA. Upon obtaining optical paths shown in FIGS. 11 and 12 by a simulation, the wavelength of light was set to 685.5 [nm] (FIG. 14).

Figure 15:
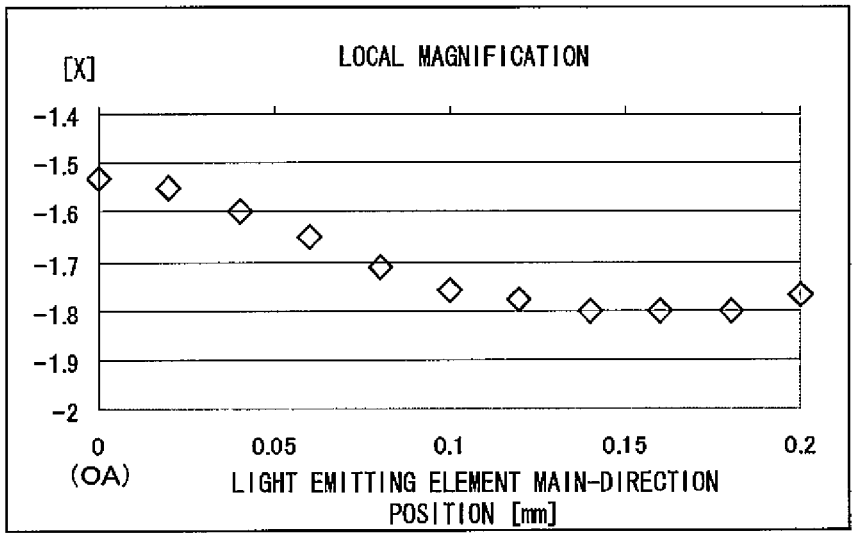
FIG. 15 is a graph showing distortions of the imaging optical system according to the first embodiment.

FIG. 15 is a graph showing distortions of the imaging optical system according to the first embodiment, wherein a horizontal axis of FIG. 15 represents light emitting element main-direction positions [mm] and a vertical axis of FIG. 15 represents main direction local magnifications [×]. Here, the light emitting element main-direction position is a distance in the main scanning direction MD (longitudinal direction LGD) between the light emitting element 2951 and the optical axis OA. The main direction local magnification is an imaging magnification in the sub scanning direction SD upon imaging a light beam emitted from the position indicated on the horizontal axis. The optical axis OA passes an origin where the horizontal axis and the vertical axis intersect.

As shown in FIG. 15, the absolute value of the main direction local magnification becomes larger as the light emitting element main-direction position becomes more distant (that is, the position of the light emitting element 2951 becomes more distant from the optical axis OA). In other words, the imaging optical system of the first embodiment has a "first aberration" of imaging light from the light emitting element 2951 more distant in the main scanning direction MD (longitudinal direction LGD) from the optical axis OA at an optical magnification with a larger absolute value in the main scanning direction MD as a distortion. Accordingly, in the case of arranging the respective light emitting elements 2951 at equal light emitting element pitches Pel in the longitudinal direction LGD in the light emitting element group 295 as shown in the basic construction, the following problem has occurred in some cases.

Figure 16:
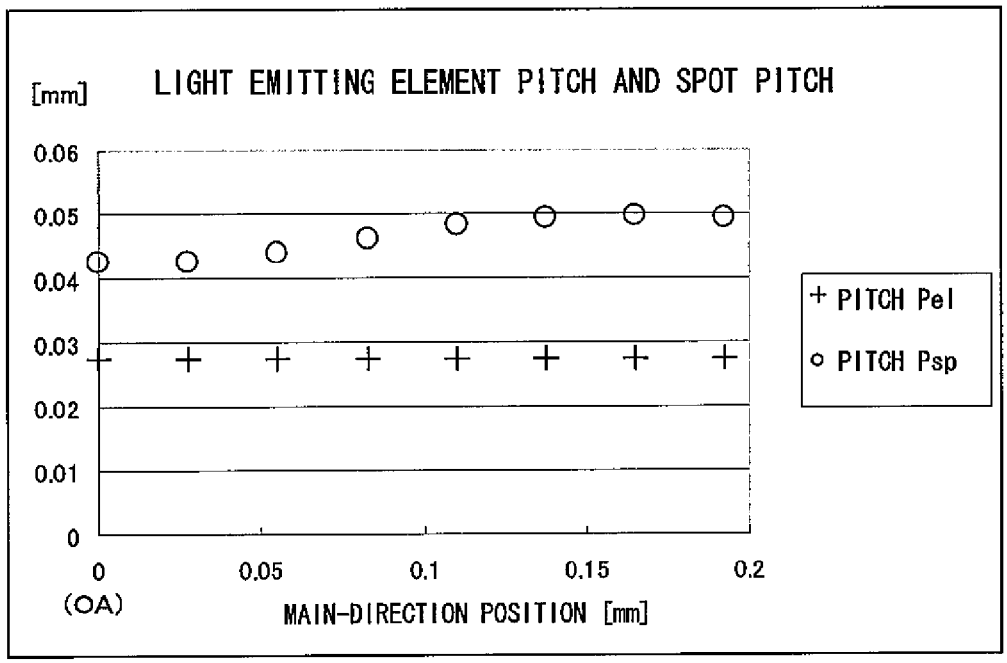
FIG. 16 is a graph showing a problem which could occur when the imaging optical system has the first aberration.

FIG. 16 is a graph showing a problem which could occur when the imaging optical system has the first aberration. A horizontal axis of FIG. 16 represents main-direction positions [mm] of the light emitting elements or the spots. A vertical axis of FIG. 16 represents the light emitting element pitches Pel (mark "+" in FIG. 16) and the spot pitches Psp (mark "○" in FIG. 16). As shown in FIG. 16, all the light emitting element pitches Pel are about 0.028 [mm] and equal to each other for the respective light emitting elements 2951. In contrast, the imaging optical system has the first aberration shown in FIG. 15. Accordingly, as shown in FIG. 16, such a spot group SG that the spot pitches Psp are widened with distance from the optical axis OA is formed. Accordingly, in the first embodiment, the light emitting element group 295 is configured as below to deal with such a problem.

Figure 17:
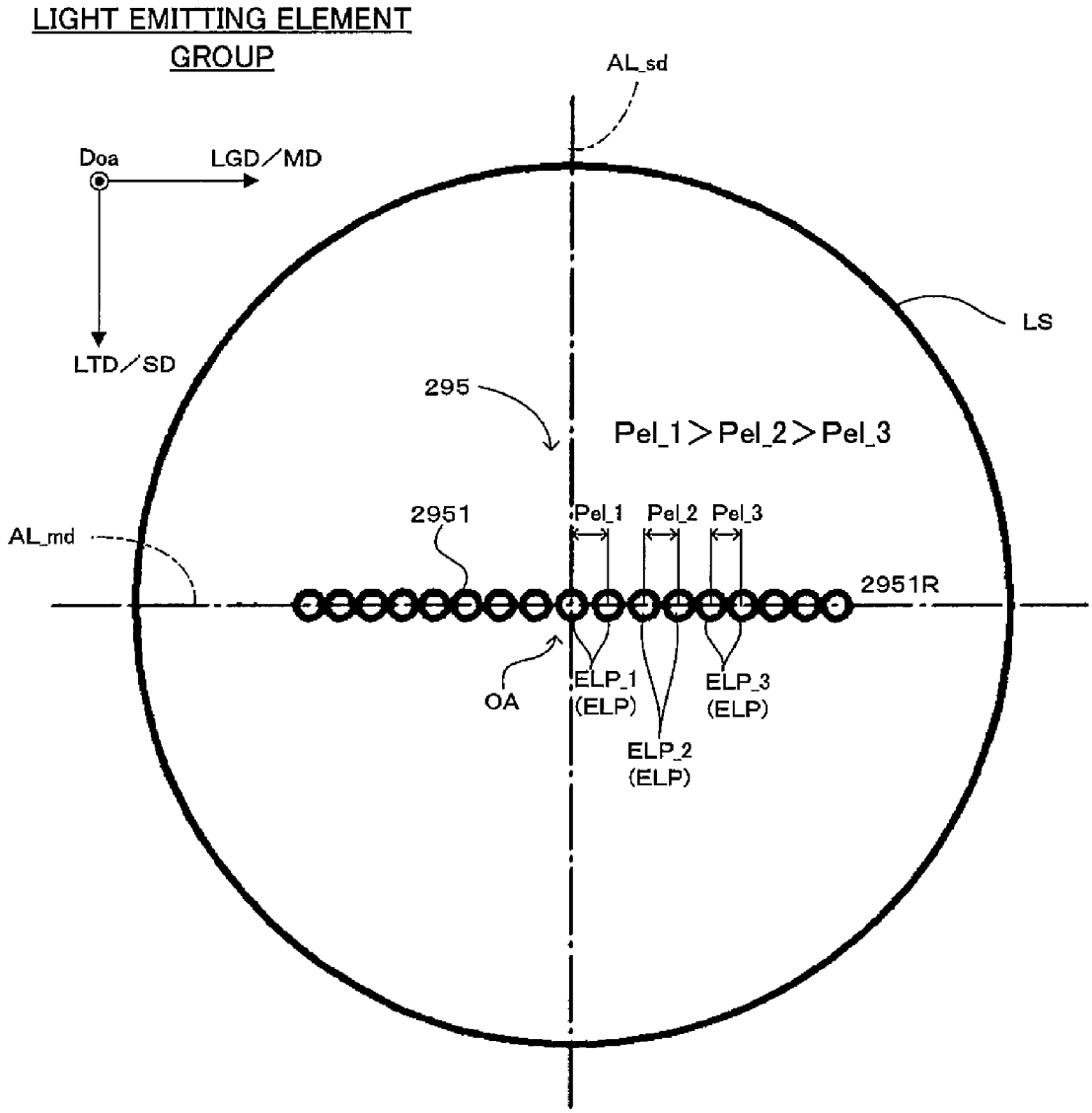
FIG. 17 is a plan view showing the configuration of a light emitting element group according to the first embodiment.
Figure 18:
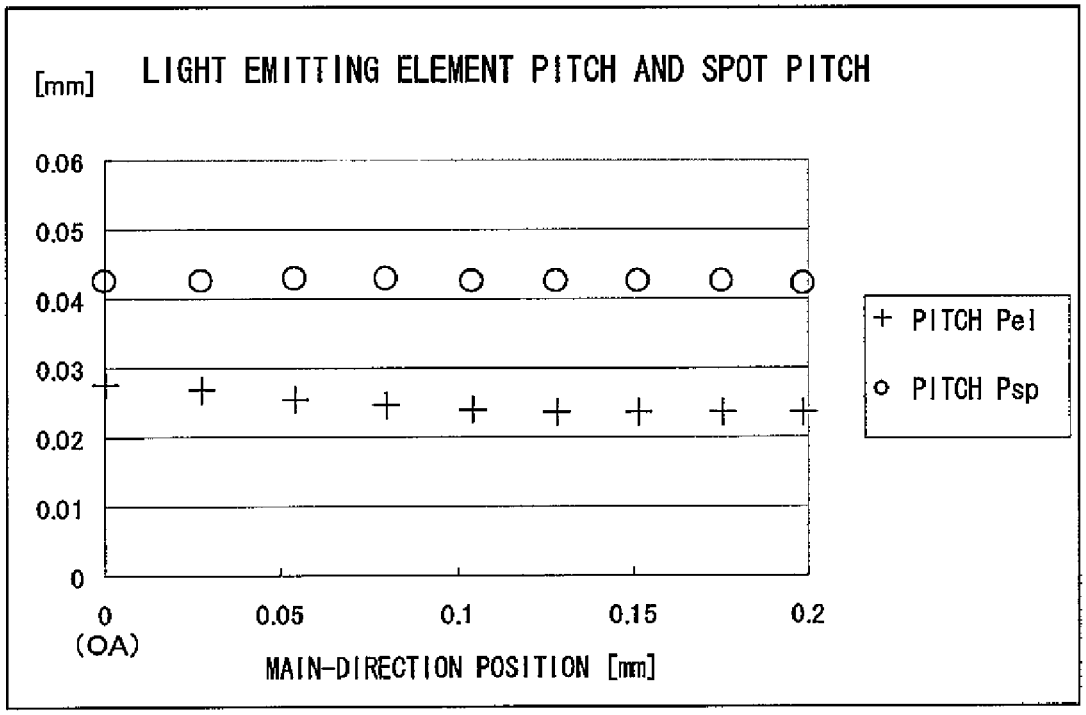
FIG. 18 is a graph showing the configuration and effect of the light emitting element group according to the first embodiment.

FIG. 17 is a plan view showing the configuration of a light emitting element group according to the first embodiment, and FIG. 18 is a graph showing the configuration and effect of the light emitting element group according to the first embodiment. A horizontal axis of FIG. 18 represents main-direction positions [mm] of light emitting elements or spots. A vertical axis of FIG. 18 represents the light emitting element pitches Pel (mark "+" in FIG. 18) and the spot pitches Psp (mark "○" in FIG. 18).

As shown in FIG. 17, seventeen light emitting elements 2951 are arranged in the longitudinal direction LGD in the light emitting element group 295. In the first embodiment, the light emitting element pitches Pel of the respective light emitting elements 2951 are adjusted beforehand (FIGS. 17, 18). In other words, two light emitting elements 2951 constituting an adjacent light emitting element pair ELP are arranged at a narrower light emitting element pitch as the adjacent light emitting element pair ELP is more distant from the optical axis OA in the longitudinal direction LGD. For example, adjacent light emitting element pairs ELP_1, ELP_2 and ELP_3 are arranged in order of distance from the optical axis OA in the longitudinal direction LGD, the adjacent light emitting element pair ELP_1 being nearest to the optical axis OA in FIG. 17. And light emitting element pitches Pel_1, Pel_2, Pel_3 of the adjacent light emitting element pairs ELP_1, ELP_2, ELP_3 satisfy the following magnitude relation:

$$Pel_1>Pel_2>Pel_3.$$

In other words, the light emitting element pitches Pel are adjusted to cancel out the first aberration of the imaging optical system in the first embodiment. Thus, as shown in FIG. 18, the respective spots SP are formed at equal spot pitches Psp (=about 0.042 [mm]) independently of the main-direction positions.

In this way, two light emitting elements 2951 of each of at least two adjacent light emitting element pairs ELP are arranged at the light emitting element pitch Pel different from each other according to the distortion in the light emitting element group 295 of the first embodiment. Accordingly, the problem resulting from the distortion of the imaging optical system can be efficiently suppressed to enable good latent image formation to be performed.

Specifically, in the light emitting element group 295, two light emitting elements 2951 constituting the adjacent light emitting element pair ELP more distant in the longitudinal direction LGD from the optical axis OA are arranged at the narrower light emitting element pitch Pel in at least two adjacent light emitting element pairs ELP. Accordingly, by canceling out the first aberration of the imaging optical system, the light emitting element group 295 can form a plurality of spots SP at substantially equal spot pitches Psp in the main scanning direction MD to enable good latent image formation to be performed.

Second Embodiment

Figure 19:
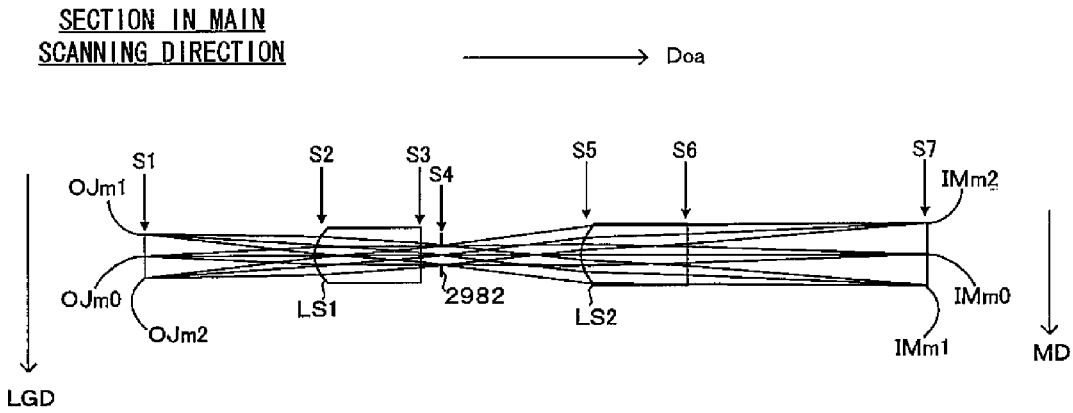
FIG. 19 is a sectional view in the main scanning direction of an imaging optical system according to a second embodiment.
Figure 20:
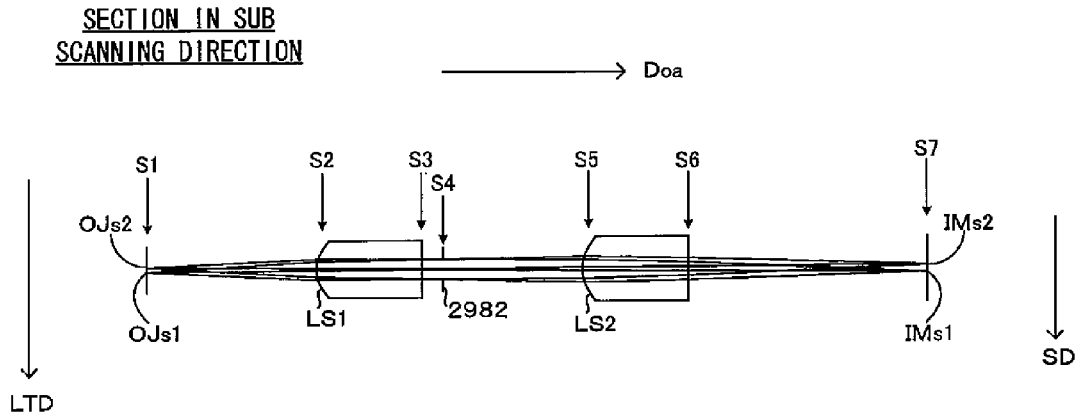
FIG. 20 is a sectional view in the sub scanning direction of the imaging optical system according to the second embodiment.

FIG. 19 is a sectional view in the main scanning direction of an imaging optical system according to a second embodiment. FIG. 20 is a sectional view in the sub scanning direction of the imaging optical system according to the second embodiment. FIG. 21 is a table showing lens data of the imaging optical system according to the second embodiment. FIG. 22 is a table showing an optical system specification of the imaging optical system according to the second embodiment. Different parts between the already described construction and the construction of the second embodiment are mainly described below and description on common parts is suitably omitted by identifying them by equivalent reference numerals.

As can be understood from FIGS. 19 to 21, a first lens LS1 and a second lens LS2 are both aspherical lenses. Further, a diaphragm 2982 is arranged between a surface S3 and an aspherical surface S5 (second lens LS2). In FIG. 19, an object point OJm0 is located on an optical axis OA and light emitted from the object point OJm0 is imaged as an image IMm0 on the optical axis OA. Lights emitted from object points OJm1, OJm2 deviated from the optical axis OA are imaged as images IMm1, IMm2 in an inverted manner. Further, as shown in FIG. 20, lights emitted from object points OJs1, OJs2 deviated from the optical axis OA are imaged as images IMs1, IMs2 in an inverted manner. Upon obtaining optical paths shown in FIGS. 19 and 20 by a simulation, the wavelength of light was set to 685.5 [nm] (FIG. 22).

Figure 23:
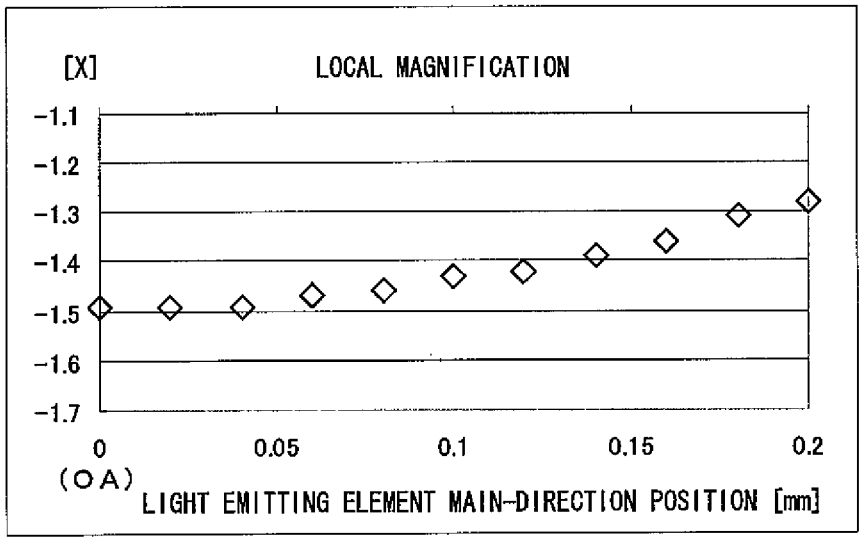
FIG. 23 is a graph showing a distortion of the imaging optical system according to the second embodiment.

FIG. 23 is a graph showing a distortion of the imaging optical system according to the second embodiment, wherein a horizontal axis of FIG. 23 represents light emitting element main-direction positions [mm] and a vertical axis of FIG. 23 represents main direction local magnifications [×]. As shown in FIG. 23, the absolute value of the main direction local magnification becomes smaller as the light emitting element main-direction position becomes more distant (that is, the position of the light emitting element 2951 becomes more distant from the optical axis OA). In other words, the imaging optical system of the second embodiment has a "second aberration" of imaging light from the light emitting element 2951 more distant in the main scanning direction MD (longitudinal direction LGD) from the optical axis OA at an optical magnification with a smaller absolute value in the main scanning direction MD as a distortion. Accordingly, if the respective light emitting elements 2951 are arranged at equal light emitting element pitches Pel in the longitudinal direction LGD in the light emitting element group 295 as shown in the basic construction, the following problem has occurred in some cases.

Figure 24:
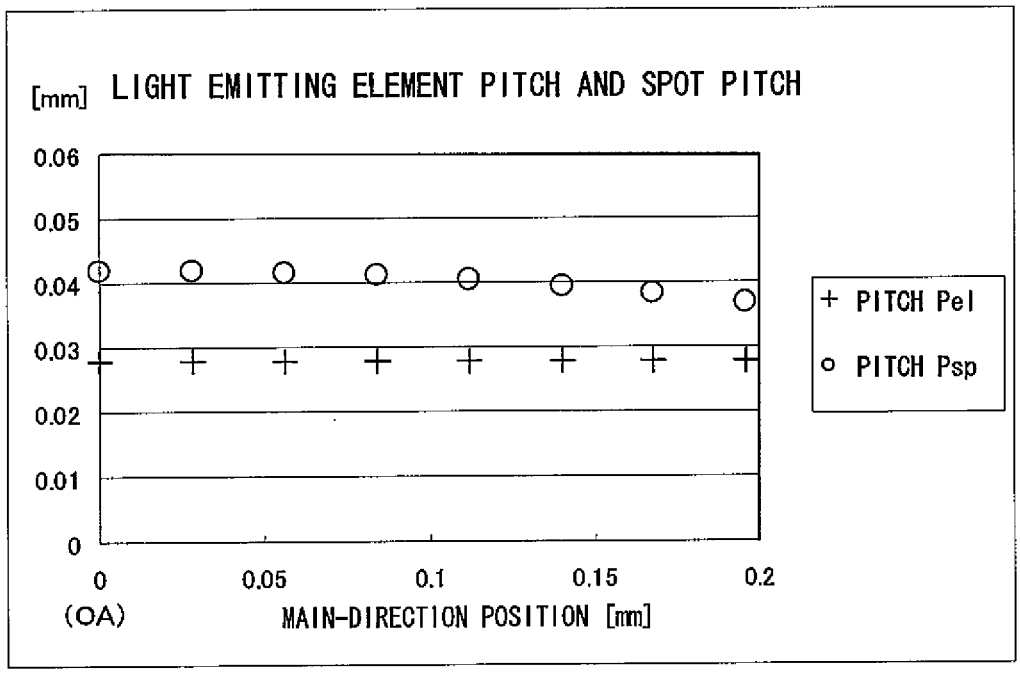
FIG. 24 is a graph showing a problem which could occur when the imaging optical system has the second distortion.

FIG. 24 is a graph showing a problem which could occur when the imaging optical system has the second distortion. A horizontal axis of FIG. 24 represents main-direction positions [mm] of the light emitting elements or the spots. A vertical axis of FIG. 24 represents light emitting element pitches Pel (mark "+" in FIG. 24) and spot pitches Psp (mark "○" in FIG. 24). As shown in FIG. 24, all the light emitting element pitches Pel are about 0.028 [mm] and equal to each other for the respective light emitting elements 2951. In contrast, the imaging optical system has the second aberration shown in FIG. 23. Accordingly, as shown in FIG. 24, such a spot group SG that the spot pitches Psp are narrowed with distance from the optical axis OA is formed. Accordingly, in the second embodiment, the light emitting element group 295 is configured as below to deal with such a problem.

Figure 25:
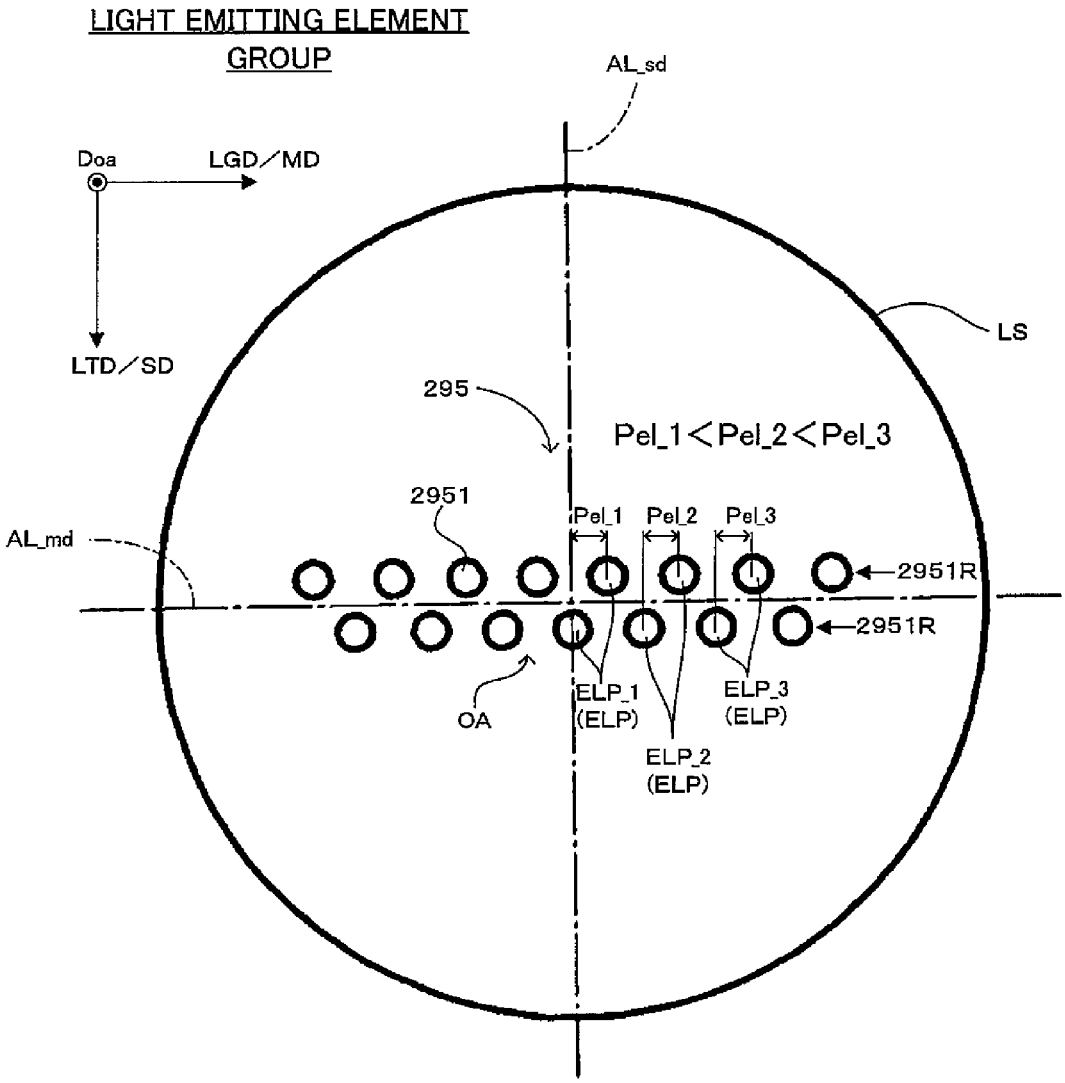
FIG. 25 is a plan view showing the configuration of a light emitting element group according to the second embodiment.
Figure 26:
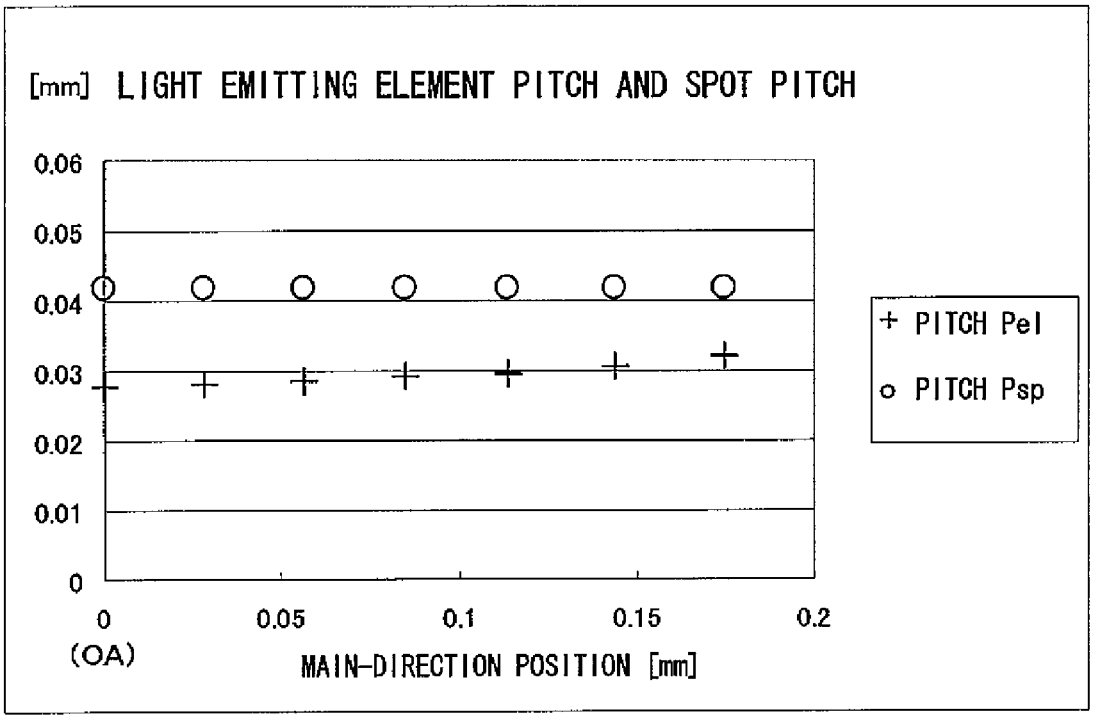
FIG. 26 is a graph showing the configuration and effect of the light emitting element group according to the second embodiment.

FIG. 25 is a plan view showing the configuration of a light emitting element group according to the second embodiment, and FIG. 26 is a graph showing the configuration and effect of the light emitting element group according to the second embodiment. A horizontal axis of FIG. 26 represents main-direction positions [mm] of light emitting elements or spots. A vertical axis of FIG. 26 represents light emitting element pitches Pel (mark "+" in FIG. 26) and spot pitches Psp (mark "○" in FIG. 26).

As shown in FIG. 25, fifteen light emitting elements 2951 are arranged in the longitudinal direction LGD in an offset manner in the light emitting element group 295. In the second embodiment, the light emitting element pitches Pel of the respective light emitting elements 2951 are adjusted beforehand (FIGS. 25, 26). In other words, two light emitting elements 2951 constituting an adjacent light emitting element pair ELP are arranged at a wider light emitting element pitch as the adjacent light emitting element pair ELP is more distant from the optical axis OA in the longitudinal direction LGD. For example, adjacent light emitting element pairs ELP_1, ELP_2 and ELP_3 are arranged in order of distance from the optical axis OA in the longitudinal direction LGD, the adjacent light emitting element pair ELP_1 being nearest to the optical axis OA in FIG. 25. And light emitting element pitches Pel_1, Pel_2, Pel_3 of the adjacent light emitting element pairs ELP_1, ELP_2, ELP_3 satisfy the following magnitude relation:

$$Pel_1<Pel_2<Pel_3.$$

In other words, the light emitting element pitches Pel are adjusted to cancel out the second aberration of the imaging optical system in the second embodiment. Thus, as shown in FIG. 26, the respective spots SP are formed at equal spot pitches Psp (=about 0.042 [mm]) independently of the main-direction positions.

In this way, two light emitting elements 2951 of each of at least two adjacent light emitting element pairs ELP are arranged at the light emitting element pitch Pel different from each other according to the distortion in the light emitting element group 295 of the second embodiment. Accordingly, the problem resulting from the distortion of the imaging optical system can be efficiently suppressed to enable good latent image formation to be performed.

Specifically, in the light emitting element group 295, two light emitting elements 2951 constituting the adjacent light emitting element pair ELP more distant in the longitudinal direction LGD from the optical axis OA are arranged at the wider light emitting element pitch Pel in at least two adjacent light emitting element pairs ELP. Accordingly, by canceling out the second aberration of the imaging optical system, the light emitting element group 295 can form a plurality of spots SP at substantially equal spot pitches Psp in the main scanning direction MD to enable good latent image formation to be performed.

Third Embodiment

Next, a third embodiment of the invention is described. This third embodiment aims to solve a problem different from those of the first and second embodiments. Specifically, in the above basic construction, a plurality of light emitting elements are used while being arranged in the longitudinal direction LGD. However, the light emitting elements 2951 generate heat when being driven for light emission. Accordingly, heat was likely to accumulate near the center of the light emitting element group 295 (in other words, near the center of gravity of the light emitting element group 295) and the thermal deterioration of the light emitting elements 2951 arranged near the center tended to accelerate. As a result, there have been cases where a degree of thermal deterioration differs among the respective light emitting elements 2951 and good latent image formation cannot be performed.

Figure 27:
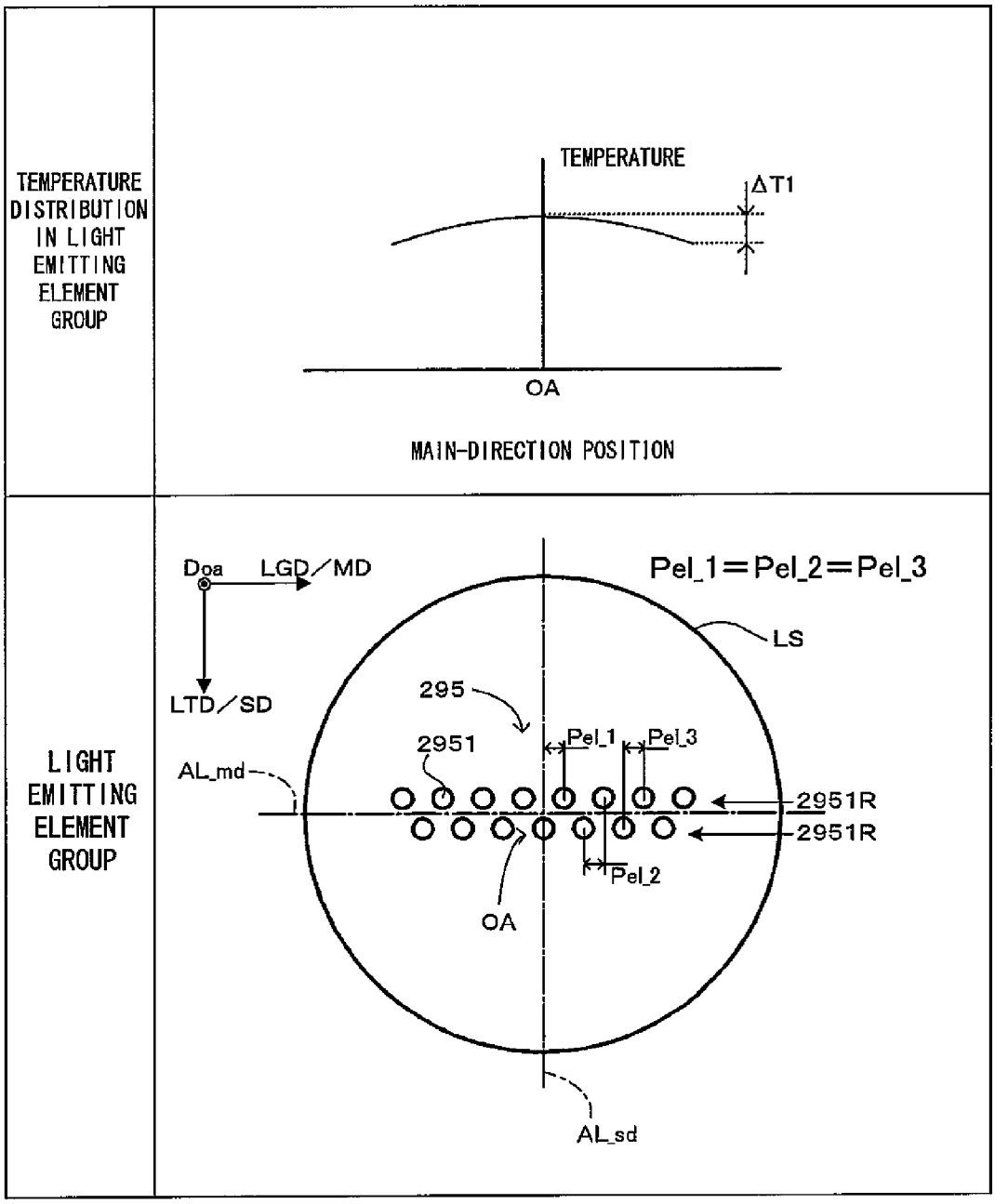
FIG. 27 is a diagram showing a problem which could occur in a construction in which a plurality of light emitting elements are arranged at equal light emitting element pitches.

FIG. 27 is a diagram showing a problem which could occur in a construction in which a plurality of light emitting elements are arranged at equal light emitting element pitches. The section "Temperature Distribution in Light Emitting Element Group" of FIG. 27 shows temperature on a first straight line AL_md wherein a horizontal axis represent main-direction positions and a vertical axis represents temperature. The main-direction positions in this section are positions on the first straight line AL_md in the main scanning direction MD (longitudinal direction LGD) and an optical axis OA is assumed as an origin. The section "Light Emitting Element Group" of FIG. 27 shows the configuration of a light emitting element group 295 in a plan view.

As shown in the section "Light Emitting Element Group", the light emitting element group 295 is arranged such that the center of gravity position thereof overlaps the optical axis OA. A plurality of light emitting elements 2951 constituting this light emitting element group 295 are arranged in an offset manner at equal light emitting element pitches Pel in the longitudinal direction LGD. As a result of arranging the respective light emitting elements 2951 in this way, a temperature distribution as shown in the section "Temperature Distribution in Light Emitting Element Group" of FIG. 27 is generated in the light emitting element group 295. As shown in this section, in the main scanning direction MD (longitudinal direction LGD), temperature is higher near the center of gravity of the light emitting element group 295 (that is, near the optical axis OA) while being lower at positions distant from the center of gravity, whereby there is a temperature difference ΔT1 between temperature near the center of gravity of the light emitting element group 295 and temperature near an end portion. As a result, there have been cases where the thermal deterioration of the light emitting elements 2951 near the center of gravity advances to create differences in a degree of thermal deterioration among the respective light emitting elements 2951. Accordingly, the light emitting element group 295 is configured as below in the third embodiment.

Figure 28:
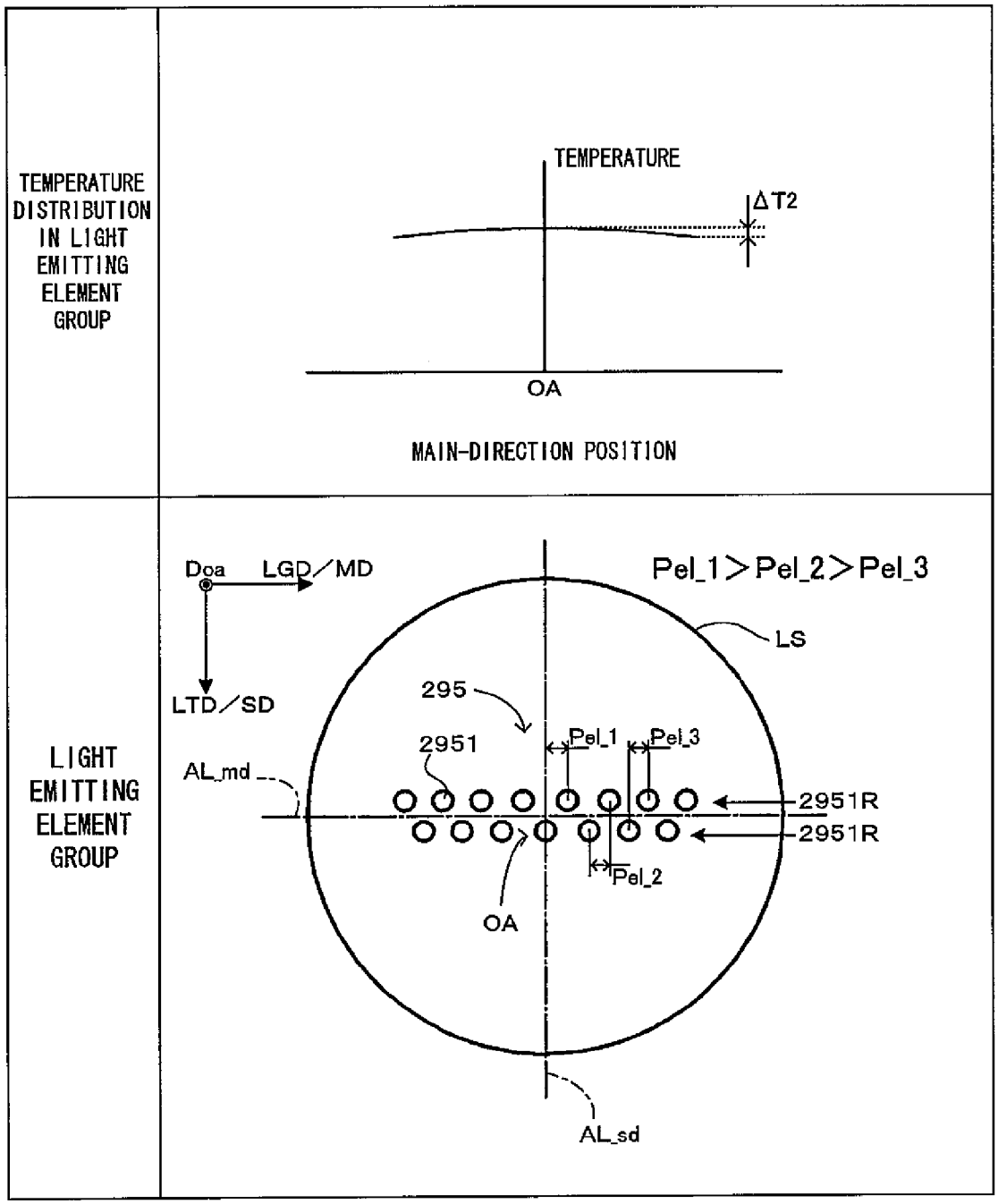
FIG. 28 is a diagram showing the configuration of the light emitting element group according to the third embodiment.

FIG. 28 is a diagram showing the configuration of the light emitting element group according to the third embodiment. The section "Temperature Distribution in Light Emitting Element Group" of FIG. 28 shows temperature on a first straight line AL_md, wherein a horizontal axis represent main-direction positions and a vertical axis represents temperature. The section "Light Emitting Element Group" of FIG. 28 shows the configuration of the light emitting element group 295 in a plan view. The light emitting element group 295 of FIG. 27 and the light emitting element group 295 of FIG. 28 are common in that the center of gravity position thereof is so arranged as to overlap the optical axis OA. However, these differ in the following point. In other words, as shown in the section "Light Emitting Element Group" of FIG. 28, two light emitting elements 2951 constituting an adjacent light emitting element pair ELP closer to the center of gravity of the light emitting element group 295 (optical axis OA in this section) in the longitudinal direction LGD are arranged at a wider light emitting element pitch Pel. For example, in FIG. 28, adjacent light emitting element pairs ELP_1, ELP_2 and ELP_3 are arranged in this order to be more distant from the optical axis OA in the longitudinal direction LGD, and light emitting element pitches Pel_1, Pel_2, Pel_3 of the adjacent light emitting element pairs ELP_1, ELP_2, ELP_3 satisfy the following magnitude relation:

$$Pel_1 > Pel_2 > Pel_3.$$

Accordingly, the light emitting elements 2951 become sparse near the center of gravity of the light emitting element group 295, thereby efficiently promoting heat radiation near the optical axis OA in the light emitting element group 295. As a result, as shown in the section "Temperature Distribution in Light Emitting Element Group", the temperature distribution in the light emitting element group 295 is leveled. Specifically, a temperature difference ΔT2 shown in FIG. 28 is smaller than the temperature difference ΔT1 shown in FIG. 27. Thus, the degree of thermal deterioration becomes substantially equal among the respective light emitting elements 2951 to enable a good latent image forming operation to be performed.

Fourth Embodiment

Figure 29:
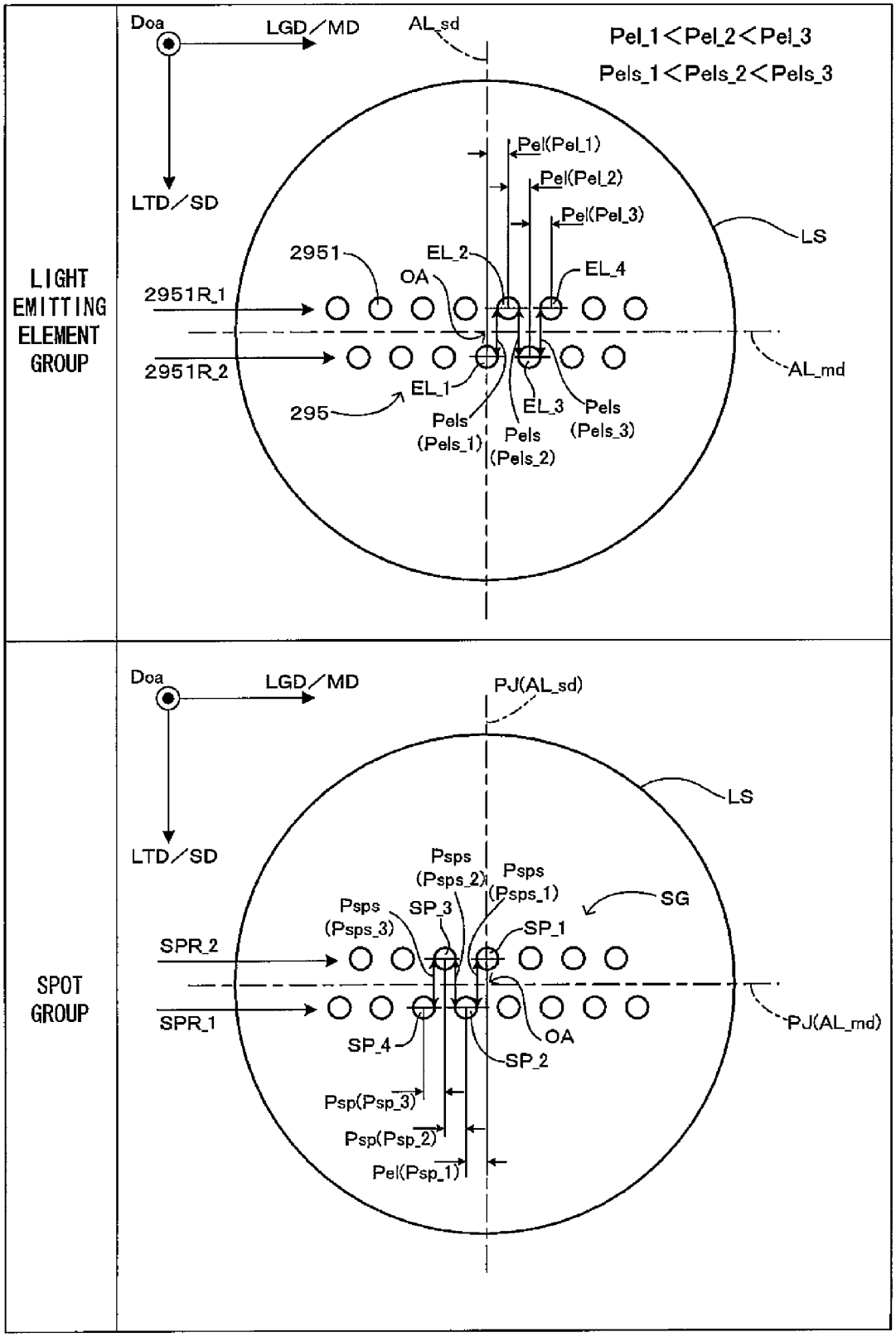
FIG. 29 is a group of plan views showing the configuration of a light emitting element group according to a fourth embodiment and a spot group formed by this light emitting element group.

FIG. 29 is a group of plan views showing the configuration of a light emitting element group according to a fourth embodiment (upper part of FIG. 29) and a spot group formed by this light emitting element group (lower part of FIG. 29). In the fourth embodiment as well, the respective light emitting elements of the light emitting element group 295 are organic EL devices formed on the head substrate under surface 293-*t* and the section "Light Emitting Element Group" in the upper part of FIG. 29 shows the head substrate under surface 293-*t*. Further, the section "Spot Group" in the lower part of FIG. 29 shows the surface of the photosensitive drum 21. Although a lens LS is shown in the respective sections, this is to indicate a correspondence relationship between the light emitting element group 295 or the spot group SG and the lens LS, but does not indicate that the lens LS is arranged on the head substrate under surface 293-*t* or the surface of the photosensitive drum 21. An imaging optical system of the fourth embodiment has the same construction as that of the second embodiment. Accordingly, the imaging optical system of the fourth embodiment has a "second aberration" of imaging light from a light emitting element 2951 more distant in the main scanning direction MD (longitudinal direction LGD) from an optical axis OA at an optical magnification with a smaller absolute value in the main scanning direction MD as a distortion.

As shown in the section "Light Emitting Element Group" in the upper part of FIG. 29, fifteen light emitting elements 2951 (EL_1, etc.) are arranged in two rows in an offset manner in the longitudinal direction LGD. As a result, two light emitting element rows 2951R_1, 2951R_2 are arranged in the width direction LTD. In this section, a reference numeral EL_1 is assigned to the light emitting element arranged on a second straight line AL_sd. Further, a reference numeral EL_2 is assigned to the light emitting element having a main-direction position adjacent to that of the light emitting element EL_1 at the right side (one side) of the light emitting element EL_1 in the longitudinal direction LGD in this section. Furthermore, a reference numeral EL_3 is assigned to the light emitting element having a main-direction position adjacent to that of the light emitting element EL_2 at the right side of the light emitting element EL_2 in the longitudinal direction LGD in this section and a reference numeral EL_4 is assigned to the light emitting element having a main-direction position adjacent to that of the light emitting element EL_3 at the right side of the light emitting element EL_3 in the longitudinal direction LGD in this section.

A reference numeral Pel_1 is assigned to a distance (main-direction inter-light emitting elements distance Pel_1) between the centers of gravity of the light emitting elements EL_1, EL_2 in the main scanning direction MD (longitudinal direction LGD). Further, a reference numeral Pel_2 is assigned to a distance (main-direction inter-light emitting elements distance Pel_2) between the centers of gravity of the light emitting elements EL_2, EL_3 in the main scanning direction MD (longitudinal direction LGD) and a reference numeral Pel_3 is assigned to a distance (main-direction inter-light emitting elements distance Pel_3) between the centers of gravity of the light emitting elements EL_3, EL_4 in the main scanning direction MD (longitudinal direction LGD). In this way, a distance in the main scanning direction MD between the centers of gravity of two light emitting elements having adjacent main-direction positions is defined as the main-direction inter-light emitting elements distance Pel. The main-direction inter-light emitting elements distance corresponds to the light emitting element pitch Pel in the first to third embodiments.

A reference numeral Pels_1 is assigned to a distance (sub-direction inter-light emitting elements distance Pels_1) between the centers of gravity of the light emitting elements EL_1, EL_2 in the sub scanning direction SD (width direction LTD). Further, a reference numeral Pels_2 is assigned to a distance (sub-direction inter-light emitting elements distance Pels_2) between the centers of gravity of the light emitting elements EL_2, EL_3 in the sub scanning direction SD (width direction LTD) and a reference numeral Pels_3 is assigned to a distance (sub-direction inter-light emitting elements distance Pels_3) between the centers of gravity of the light emitting elements EL_3, EL_4 in the sub scanning direction SD (width direction LTD). In this way, a distance in the sub scanning direction SD between the centers of gravity of two light emitting elements having adjacent main-direction positions is defined as the sub-direction inter-light emitting elements distance Pels.

The spot group SG shown in the section "Spot Group" is formed by the light emission of the respective light emitting elements of this light emitting element group 295. In the section "Spot Group", reference numerals SP_1 to SP_4 are assigned to spots formed by the light emitting elements EL_1 to EL_4. Further, a reference numeral Psp_1 is assigned to a distance (main-direction inter-spots distance Psp_1) in the main scanning direction MD between the centers of gravity of the spots SP_1, SP_2, and reference numerals Psp_2, Psp_3 are similarly assigned to main-direction inter-spots distances. In this way, a distance in the main scanning direction MD between the centers of gravity of two spots SP having adjacent main-direction positions is defined as the main-direction inter-spots distance Psp. Further, a reference numeral Psps_1 is assigned to a distance (sub-direction inter-spots distance Psps_1) in the sub scanning direction SD between the centers of gravity of the spots SP_1, SP_2, and reference numerals Psps_2, Psps_3 are similarly assigned to sub-direction inter-spots distances. In this way, a distance in the sub scanning direction SD between the centers of gravity of two spots SP having adjacent main-direction positions is defined as the sub-direction inter-spots distance Psps.

The imaging optical system of the fourth embodiment has the second aberration as described above (FIG. 23). Accordingly, in order to make the main-direction inter-spots distances Psp constant independently of the second aberration, the light emitting elements are arranged at larger main-direction inter-light emitting elements distances Pet as they are more distant from the optical axis OA. For example, the light emitting elements EL_1 to EL_4 are arranged such that the main-direction inter-light emitting elements distances Pel satisfy the following magnitude relation:

$$Pel_1<Pel_2<Pel_3.$$

Thus, the spots SP_1 to SP_4 are arranged at equal main-direction inter-spots distances Psp in the main scanning direction MD.

Figure 30:
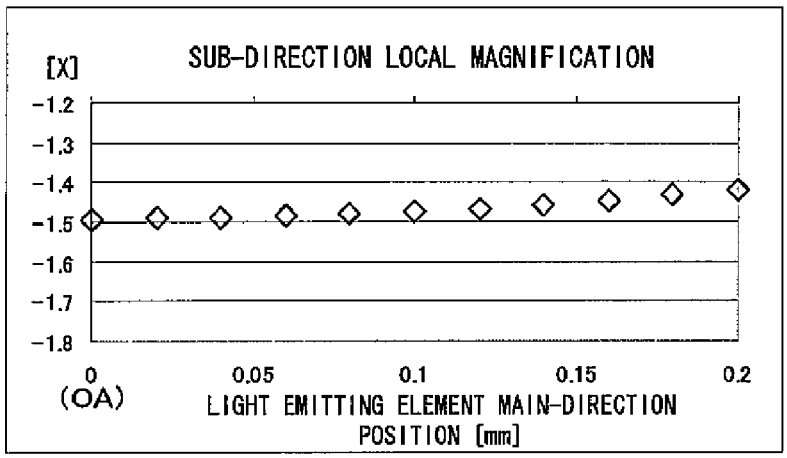
FIG. 30 is a graph showing a distortion of the imaging optical system according to the fourth embodiment.

The imaging optical system of the fourth embodiment has a distortion not only in the main scanning direction MD, but also in the sub scanning direction SD. FIG. 30 is a graph showing a distortion of the imaging optical system according to the fourth embodiment, wherein a horizontal axis of FIG. 30 represents light emitting element main-direction positions [mm] and a vertical axis of FIG. 30 represents sub-direction local magnifications [×]. Here, the sub-direction local magnification is an imaging magnification in the sub scanning direction SD upon imaging a light beam emitted from the position indicated on the horizontal axis. An optical axis OA passes an origin where the horizontal axis and the vertical axis intersect. As shown in FIG. 30, the absolute value of the sub-direction local magnification becomes smaller as the light emitting element main-direction position becomes more distant (that is, the position of the light emitting element 2951 becomes more distant from the optical axis OA). In other words, the imaging optical system of the fourth embodiment has a "fourth aberration" of imaging light from the light emitting element 2951 more distant from the optical axis OA in the main scanning direction MD (longitudinal direction LGD) at an optical magnification with a smaller absolute value in the sub scanning direction SD as a distortion. Accordingly, if the respective light emitting elements 2951 are arranged at equal sub-direction inter-light emitting elements distances Pels in the light emitting element group 295, the following problem has occurred in some cases.

Figure 31:
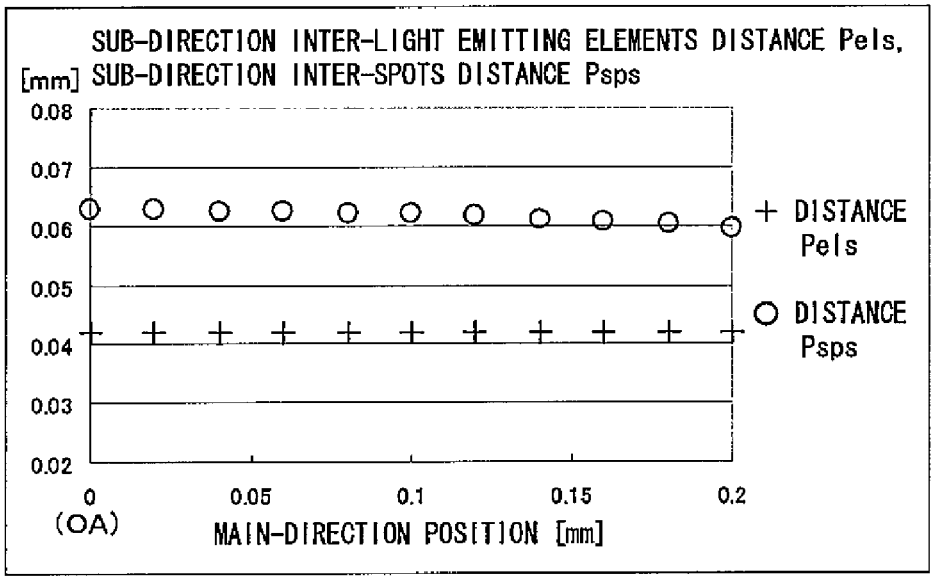
FIG. 31 is a graph showing a problem which could occur when the imaging optical system has the fourth aberration.

FIG. 31 is a graph showing a problem which could occur when the imaging optical system has the fourth aberration. A horizontal axis of FIG. 31 represents main-direction positions [mm] of the light emitting elements or the spots. A vertical axis of FIG. 31 represents sub-direction inter-light emitting elements distances Pels (mark "+" in FIG. 31) and sub-direction inter-spots distances Psps (mark "○" in FIG. 31). As shown in FIG. 31, all the sub-direction inter-light emitting elements distances Pels are about 0.042 [mm] and equal to each other for the respective light emitting elements 2951. In contrast, the imaging optical system has the fourth aberration shown in FIG. 30. Accordingly, as shown in FIG. 31, such a spot group SG that the sub-direction inter-spots distances Psps are narrowed with distance from the optical axis OA is formed. In other words, the spot group SG is formed to have such a barrel shape as to expand in a middle part near the second straight line AL_sd and to contract at the opposite ends. As a result, even if it is tried to form a line latent image as shown in FIG. 10, there has been a likelihood of making the line latent image nonlinear.

Figure 32:
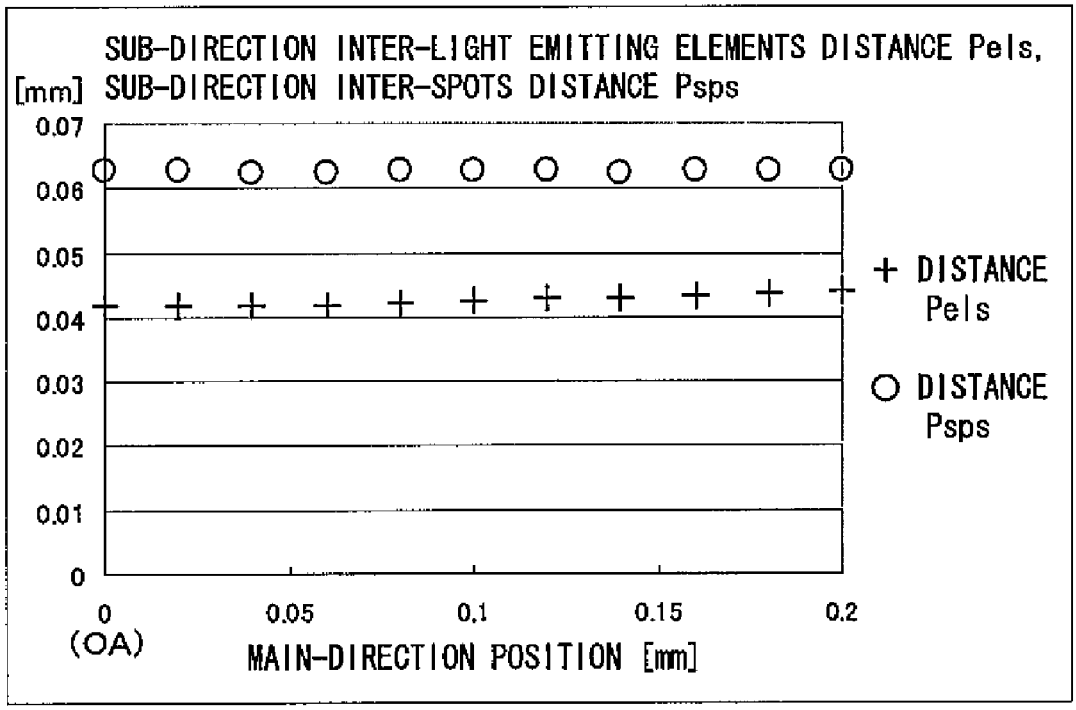
FIG. 32 is a graph showing the configuration and effect of the fourth embodiment.

Accordingly, in the fourth embodiment, the light emitting element group 295 is configured as shown in FIGS. 29 and 32 to deal with such a problem. Here, FIG. 32 is a graph showing the configuration and effect of the fourth embodiment. A horizontal axis of FIG. 32 represents main-direction positions [mm] of the light emitting elements or the spots. A vertical axis of FIG. 32 represents sub-direction inter-light emitting elements distances Pels (mark "+" in FIG. 32) and sub-direction inter-spots distances Psps (mark "○" in FIG. 32). As shown in FIGS. 29 and 32, in order to make the sub-direction inter-spots distances Psps constant independently of the fourth aberration, the light emitting elements are arranged at larger sub-direction inter-light emitting elements distances Pels as they are more distant from the optical axis OA. For example, the light emitting elements EL_1 to EL_4 shown in FIG. 29 are arranged such that the sub-direction inter-light emitting elements distances Pels satisfy the following magnitude relation:

$$Pels_1<Pels_2<Pels_3.$$

Thus, the spots SP_1 to SP_4 are arranged at equal sub-direction inter-spots distances Psp in the sub scanning direction SD. In other words, in the fourth embodiment, the sub-direction inter-light emitting elements distances Pels are adjusted to cancel out the fourth aberration of the imaging optical system. Thus, as shown in FIG. 32, the spots SP are formed at equal sub-direction inter-spots distances Psps (=about 0.063 [mm]) independently of the main-direction positions.

In this way, the main-direction inter-light emitting elements distances Pel of the respective light emitting elements 2951 of the light emitting element group 295 are adjusted according to the distortions of the imaging optical systems in the main scanning direction MD in a line head 29 (exposure head) according to the fourth embodiment. Accordingly, by suppressing the influence of the distortions of the imaging optical systems on spot formation, the respective spots can be formed at equal main-direction inter-spots distances Psp to enable good spot formation.

This is described by way of an example. In the fourth embodiment, the light emitting element EL_1 (first light emitting element) and the light emitting element EL_2 (second light emitting element) are arranged such that a distance in the main scanning direction MD (first direction) between the centers of gravity thereof is a distance Pel_1 (first distance), and the light emitting element EL_2 (second light emitting element) and the light emitting element EL_3 (third light emitting element) are arranged such that a distance in the main scanning direction MD between the centers of gravity thereof is a distance Pel_2 (second distance). The distances Pel_1 and Pel_2 are made different (Pel_1 <Pel_2) according to the second aberration of the imaging optical system in the main scanning direction MD. Thus, the respective spots SP formed by the light emitting elements EL_1 to EL_3 are arranged at equal main-direction inter-spots distances Psp in the main scanning direction MD to enable good spot formation.

Further, in the fourth embodiment, the sub-direction inter-light emitting elements distances Pels of the respective light emitting elements 2951 of the light emitting element group 295 are adjusted according to the distortion of the imaging optical system in the sub scanning direction SD. Thus, the respective spots SP can be formed at equal sub-direction inter-spots distances Psps to enable good spot formation.

This is described by way of an example. In the fourth embodiment, the light emitting element EL_2 (second light emitting element) is arranged at a side of the light emitting elements EL_1 (first light emitting element) and the light emitting element EL_3 (third light emitting element) in the sub scanning direction SD (width direction LTD). Further, the light emitting element EL_1 (first light emitting element) and the light emitting element EL_2 (second light emitting element) are arranged such that a distance in the sub scanning direction SD (second direction) between the centers of gravity thereof is a distance Pels_1 (third distance), and the light emitting element EL_2 (second light emitting element) and the light emitting element EL_3 (third light emitting element) are arranged such that a distance in the sub scanning direction SD between the centers of gravity thereof is a distance Pels_2 (fourth distance). The distances Pels_1 and Pels_2 are made different (Pels_1<Pels_2) according to the fourth aberration of the imaging optical system. Thus, the respective spots SP are formed at equal sub-direction inter-spots distances Psps by the light emitting elements EL_1 to EL_3, thereby enabling good spot formation capable of suppressing the above formation of a nonlinear line latent image.

Miscellaneous

As described above, in the above embodiments, the longitudinal direction LGD and the main scanning direction MD correspond to a "first direction" of the invention, and the width direction LTD and the sub scanning direction SD correspond to a "second direction" of the invention. The lenses LS1, LS2 function as an "imaging optical system" of the invention. The light emitting element group 295 corresponds to "four or more light emitting elements" of the invention. The head substrate 293 corresponds to a "substrate" of the invention. The photosensitive drum 21 corresponds to a "latent image carrier" of the invention. The line head 29 corresponds to an "exposure head" of the invention. In the first to third embodiments, two light emitting elements arranged at the light emitting element pitch Pel_1 constitute a "first light emitting element pair" of the invention, and two light emitting elements arranged at the light emitting element pitch Pel_2 constitute a "second light emitting element pair" of the invention.

The invention is not limited to the above embodiments, and various changes other than the above can be made without departing from the gist thereof. Specifically, in the first and second embodiments, two light emitting elements 2951 of each of at least two adjacent light emitting element pairs ELP are arranged at the light emitting element pitch Pel different from each other in order to remedy the problem resulting from the distortion of the imaging optical system. Further, in the third embodiment, two light emitting elements 2951 of each of at least two adjacent light emitting element pairs ELP are arranged at the light emitting element pitch Pel different from each other in order to reduce the influence of the problem resulting from the heat generation of the light emitting elements 2951. However, two light emitting elements 2951 of each of at least two adjacent light emitting element pairs ELP may be arranged at the light emitting element pitch Pel different from each other in order to remedy problems (for example, shading of the imaging optical system, etc.) other than these.

Further, in the above first and second embodiments, a plurality of spots SP are arranged at equal spot pitches Psp in the main scanning direction MD by canceling out the first and second aberrations of the imaging optical system. In other words, a variation (that is, errors) of spot pitches Psp is substantially completely suppressed, so to speak. However, in the case where a variation of the spot pitches Psp can be permitted to a certain degree judging from required image quality or the like, an embodiment may be structured such that the variation of the spot pitches Psp is eased up to such a permissible level.

In other words, the effects of the invention can be judged to be exhibited if a variation of spot pitches Psp in a spot group SG formed by imaging light beams from a light emitting element group 295 according to the invention by an imaging optical system having a distortion is eased up as compared with a variation of spot pitches Psp in a spot group SG formed by imaging light beams from a light emitting element group 295, in which a plurality of light emitting elements 2951 are arranged at equal light emitting element pitches Pel in the longitudinal direction LGD, by the same imaging optical system.

Further, the above arrangement of two light emitting elements 2951 of each of at least two adjacent light emitting element pairs ELP at the light emitting element pitch Pel different from each other has the following functions and effects in addition to the above functions and effects. Specifically, in the case where the light emitting elements 2951 are organic EL devices as in the above embodiments, an organic EL material needs to be applied to the head substrate 293 on which the light emitting elements 2951 are arranged. At this time, the application nonuniformity of the organic EL material is preferably small in order to level the emission characteristics of the respective light emitting elements 2951. In view of this, the above arrangement of the light emitting elements 2951 is advantageous in applying the organic EL material with small application nonuniformity.

With reference to FIG. 28 showing the third embodiment, a light emitting element pitch Pel between the right one of the two light emitting elements arranged at the light emitting element pitch Pel_and the left one of the two light emitting elements arranged at the light emitting element pitch Pel_2 is not specially mentioned. However, radiation of heat accumulated near the center of gravity of the light emitting element group 295 (near the optical axis OA in FIG. 28) is promoted so as to be able to suppress differences in the degree of deterioration among the light emitting elements by setting the light emitting element pitch Pel (second distance) shorter than the light emitting element pitch Pel_1 (first distance) and longer than the light emitting element Pel_2. As a result, good spot formation is possible. In this case, for example, the right one of two light emitting elements arranged at this light emitting element pitch Pel corresponds to a "third light emitting element" of the invention. Further, the left one of the two light emitting elements arranged at the light emitting element pitch Pel_1 corresponds to a "first light emitting element" of the invention and the right one corresponds to a "second light emitting element" of the invention.

In the above fourth embodiment is described the case where the distortion is the "second aberration" of imaging light from the light emitting element 2951 more distant from the optical axis OA in the main scanning direction MD (longitudinal direction LGD) at an optical magnification with a smaller absolute value in the main scanning direction MD However, the invention is also applicable in the case where the distortion is the "first aberration" of imaging light from the light emitting element 2951 more distant from the optical axis OA in the main scanning direction MD (longitudinal direction LGD) at an optical magnification with a larger absolute value in the main scanning direction MD. In this case, the main-direction inter-light emitting elements distances Pel may be adjusted according to the first aberration. Taking as an example, the respective spots SP are satisfactorily formed at equal main-direction inter-spots distances Psp by the light emitting elements EL_1 to EL_3 by making the distances Pel_1, Pel_2 different (Pel_1 >Pel_2) according to the first aberration.

In the above fourth embodiment is described the case where the imaging optical system has the "fourth aberration" of imaging light from the light emitting element 2951 more distant from the optical axis OA in the main scanning direction MD (longitudinal direction LGD) at an optical magnification with a smaller absolute value in the sub scanning direction SD. However, the invention is also applicable in the case where the imaging optical system has the "third aberration" of imaging light from the light emitting element 2951 more distant from the optical axis OA in the main scanning direction MD (longitudinal direction LGD) at an optical magnification with a larger absolute value in the sub scanning direction SD. In this case, the sub-direction inter-light emitting elements distances Pels may be adjusted according to the third aberration. Taking as an example, the respective spots SP are formed at equal sub-direction inter-spots distances Psps by the light emitting elements EL_1 to EL_3 by making the distances Pels_1, Pels_2 different (Pels_1>Pels_2) according to the third aberration. Hence, good spot formation can be realized which can suppress the formation of a nonlinear line latent image as described above.

Although the light emitting elements 2951 are circular in the above embodiments, the shape of the light emitting elements is not limited to this and may be rectangular or elliptical. Regardless of the shape, the positions of the light emitting elements 2951 can be obtained as the centers of gravity of the light emitting elements 2951 in a plan view.

The number of the light emitting elements 2951 or the number of the light emitting element rows 2951R in the light emitting element group 295 can be suitably changed. Further, the number of light emitting elements 2951 constituting the light emitting element row 2951R can also be suitably changed.

Further, the number of the light emitting element group rows 295R or the number of the lens rows LSR can also be suitably changed.

Further, although the two lens arrays 299 are used in the above embodiments, the number of the lens arrays 299 is not limited to this.

In the above embodiments, bottom emission-type organic EL devices are used as the light emitting elements 2951. However, top emission-type organic EL devices may be used as the light emitting elements 2951 or LEDs (light emitting diodes) may be used as the light emitting elements 2951.

Figure 33:
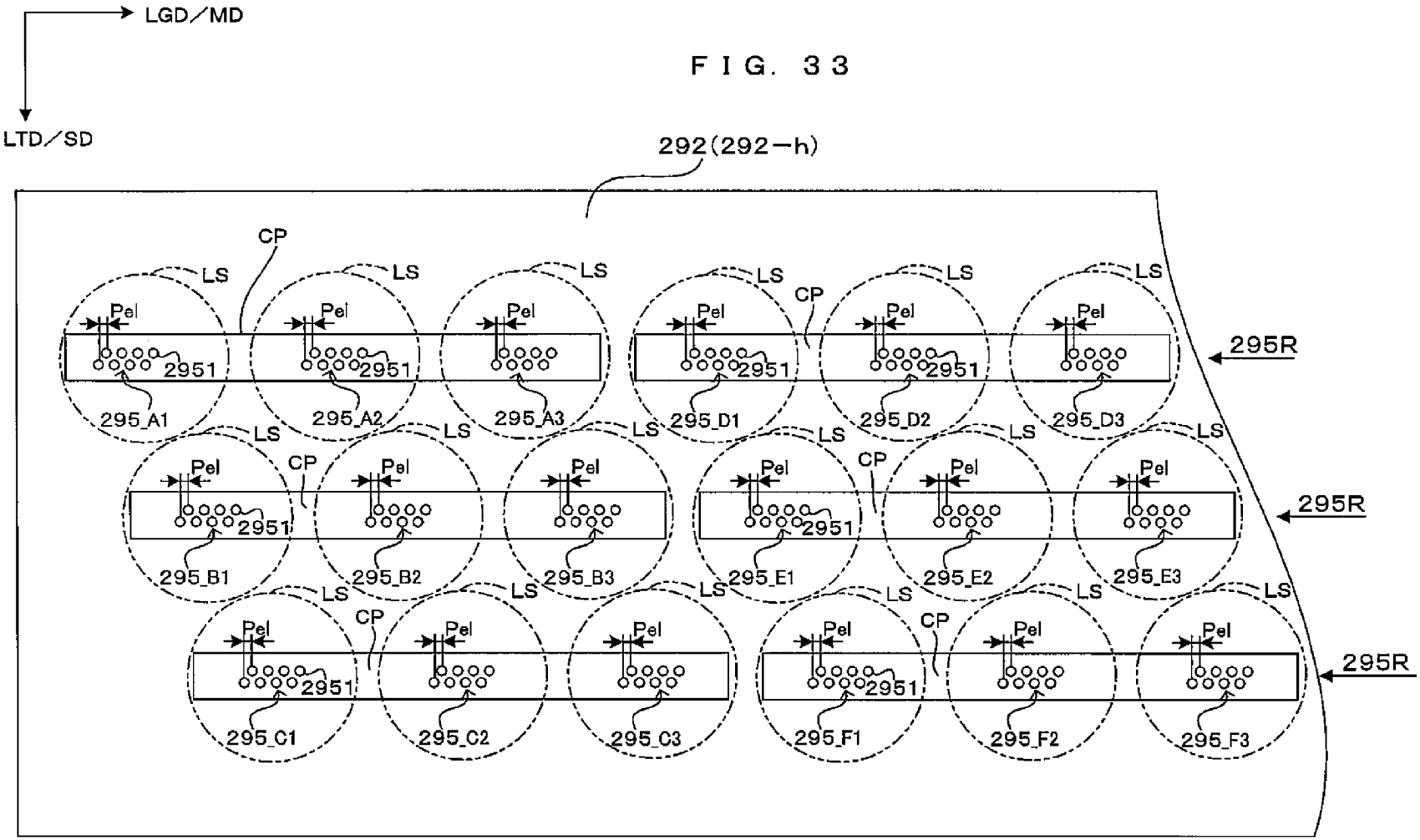
FIG. 33 is a plan view showing a construction using LED devices as light emitting elements.
Figure 34:
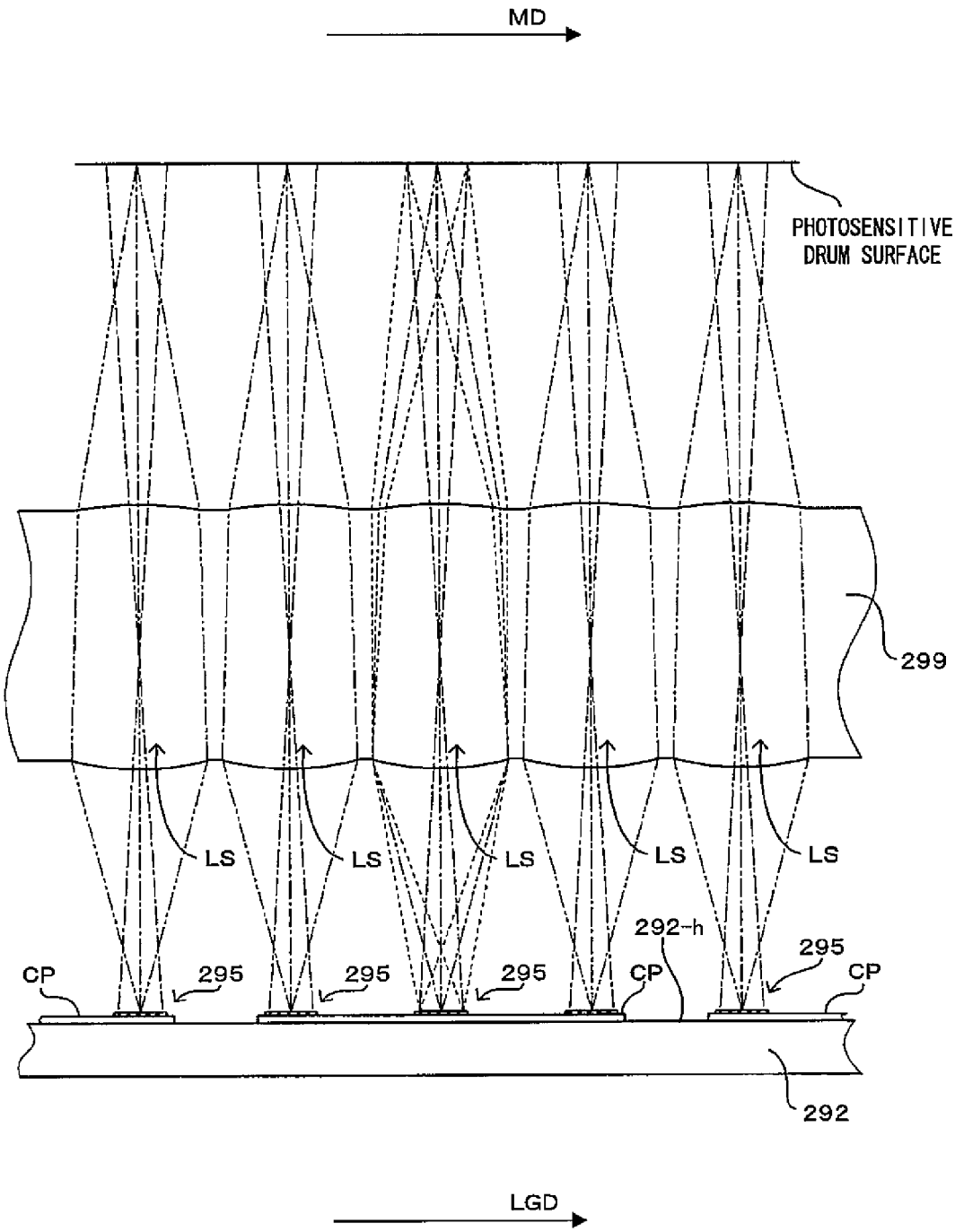
FIG. 34 is a partial sectional view in the longitudinal direction showing the construction using the LED devices as the light emitting elements.

FIG. 33 is a plan view showing a construction using LED devices as light emitting elements and corresponds to a case where the construction of a top surface 292-*h* of a mounting board 292 is seen from above. Although lenses LS are shown in FIG. 33, this is to indicate a relationship between the lenses LS and light emitting element groups 295, but does not indicate that the lenses LS are arranged on the mounting board top surface 292-*h*. FIG. 34 is a partial sectional view in the longitudinal direction showing the construction using the LED devices as the light emitting elements. In FIG. 34, trajectories of light beams emitted from a central part and opposite ends of the light emitting element groups 295 in the longitudinal direction LGD are shown in chain double-dotted lines or broken lines. As shown in FIGS. 33 and 34, the LED devices as the light emitting elements 2951 are formed on a semiconductor chip CP. On the semiconductor chip CP, three light emitting element groups 295 each as a group of a plurality of (eight) light emitting elements 2951 are formed side by side in a long axis direction of the semiconductor chip CP. A plurality of semiconductor chips CP are mounted on the top surface 292-*h* of the mounting board 292 in the form of a flat board. At this time, the long axis directions of the respective semiconductor chips CP are parallel to the longitudinal direction LGD. The effects of the invention can be exhibited by adjusting main-direction inter-light emitting elements distances Pel similar to the above embodiments also for such a line head 29 using the LED devices as the light emitting elements. As described above, in the construction shown in FIGS. 33 and 34, the semiconductor chip CP corresponds to the "substrate" of the invention and the mounting board 292 corresponds to a "board" of the invention. Although three light emitting element groups 295 are formed on one semiconductor chip CP in this construction, the number of the light emitting element groups 295 formed on one semiconductor chip CP is not limited to this.

Although the imaging optical systems used in the above embodiments have the inverting and enlarging optical characteristic, the imaging optical systems are not limited to these and it is also possible to use imaging optical systems having an erecting or reducing optical characteristic.

In an embodiment according to the invention, a first distance between a first and a second light emitting elements and a second distance between a second and a third light emitting elements may be made different according to a distortion of an imaging optical system in a first direction. Specifically, the following construction can be employed for the one in which the first, the second and the third light emitting elements are arranged at one side of an optical axis of the imaging optical system in the first direction.

In other words, in the case where the imaging optical system has a first aberration of imaging light more distant from the optical axis in the first direction at an optical magnification with a larger absolute value as the distortion in the first direction, it is possible to satisfactorily form spots independently of the first aberration by setting the second distance shorter than the first distance.

Alternatively, in the case where the imaging optical system has a second aberration of imaging light more distant from the optical axis in the first direction at an optical magnification with a smaller absolute value as the distortion in the first direction, it is possible to satisfactorily form spots independently of the second aberration by setting the second distance longer than the first distance.

The first, the second and the third light emitting elements need not be linearly arranged in the first direction, and the second light emitting element may be arranged at a side in a second direction orthogonal to the first direction with respect to the first and the third light emitting elements. However, in the case where the imaging optical system has a distortion in the second direction, the following construction is preferably employed.

In other words, the first and the second light emitting elements are arranged at a third distance from each other in the second direction and the second and the third light emitting elements are arranged at a fourth distance, which is different from the third distance, from each other in the second direction. By making the distance between the first and the second light emitting elements in the second direction and the distance between the second and the third light emitting elements in the second direction different in this way, spots can be satisfactorily formed by suppressing the influence of the distortion in the second direction on spot formation.

In other words, the third and the fourth distances may be made different according to the distortion of the imaging optical system in the second direction. More specifically, in the case where the imaging optical system has a third aberration of imaging light more distant from the optical axis in the first direction at an optical magnification with a larger absolute value in the second direction as the distortion in the second direction, the fourth distance may be set shorter than the third distance. Alternatively, in the case where the imaging optical system has a fourth aberration of imaging light more distant from the optical axis in the first direction at an optical magnification with a smaller absolute value in the second direction as the distortion in the second direction, the fourth distance may be set longer than the third distance.

In the case where four or more light emitting elements, which include the first, the second and the third light emitting elements and generate heat by light emission, are arranged on the substrate, there is a likelihood that the degree of thermal deterioration differs among the respective light emitting elements and good spot formation cannot be realized as described above. Accordingly, such a construction may be employed in which the imaging optical system images light from the four or more light emitting elements, the first, the second and the third light emitting elements are arranged at one side in the first direction in the four or more light emitting elements and the first distance is set longer than the second distance. By employing such a construction, spots can be satisfactorily formed by suppressing the above differences in the degree of thermal deterioration among the light emitting elements.

The light emitting elements may be organic EL devices formed on the substrate. Alternatively, the light emitting elements may be LED devices, the substrate may be a semiconductor chip formed with LEDs and the semiconductor chip may be arranged on a board.

Further, an embodiment of an exposure head may be so constructed as to comprise a substrate including a first light emitting element pair made up of two light emitting elements arranged at a first distance from each other in a first direction and a second light emitting element pair made up of two light emitting elements arranged at a second distance, which is different from the first distance, from each other in the first direction and arranged at a side of the first light emitting element pair in the first direction and an imaging optical system for imaging light from the light emitting elements constituting the first light emitting element pair and light from the light emitting elements constituting the second light emitting element pair. It is possible to satisfactorily form spots by making the distances in the first direction different between the first light emitting element pair and the second light emitting element pair in this way.

An embodiment of a line head according to another aspect of the invention comprises a substrate that is provided with three or more light emitting elements arranged at positions different from each other in a first direction and an imaging optical system that is arranged for the three or more light emitting elements and images light from the light emitting elements. An adjacent light emitting element pair is a pair of two of the three or more light emitting elements whose positions in the first direction are adjacent. A light emitting element pitch is a pitch in the first direction between the two light emitting elements constituting the adjacent light emitting element pair. Two light emitting elements of each of at least two adjacent light emitting element pairs are arranged at a light emitting element pitch different from each other.

An embodiment of an image forming apparatus according to still another aspect of the invention comprises a line head including a substrate that is provided with three or more light emitting elements arranged at positions different from each other in a first direction and an imaging optical system arranged for the three or more light emitting elements, and a latent image carrier. The line head images light from the light emitting elements by the imaging optical system to expose a surface of the latent image carrier. An adjacent light emitting element pair is a pair of two of the three or more light emitting elements whose positions in the first direction are adjacent. A light emitting element pitch is a pitch in the first direction between the two light emitting elements constituting the adjacent light emitting element pair. Two light emitting elements of each of at least two adjacent light emitting element pairs are arranged at a light emitting element pitch different from each other.

In the embodiments (line head, image forming apparatus) thus constructed, the two light emitting elements of each of at least two adjacent light emitting element pairs are arranged at the light emitting element pitch different from each other. Thus, the influence of the problem resulting from the distortion of the imaging optical system and the problem resulting from the heat generation of the light emitting elements can be reduced to enable good latent image formation to be performed.

The imaging optical system may have a distortion and the two light emitting elements of each of at least two adjacent light emitting element pairs may be arranged at the light emitting element pitch different from each other according to the distortion. By employing such a construction, the problem resulting from the distortion of the imaging optical system can be efficiently suppressed to enable good latent image formation to be performed.

In other words, the imaging optical system may have a first aberration of imaging light from the light emitting element more distant from the optical axis in the first direction at an optical magnification with a larger absolute value in the first direction as the distortion, and the two light emitting elements of each of at least two adjacent light emitting element pairs may be arranged at a narrower light emitting element pitch for the adjacent light emitting element pair more distant from the optical axis in the first direction. Alternatively, the imaging optical system may have a second aberration of imaging light from the light emitting element more distant from the optical axis in the first direction at an optical magnification with a smaller absolute value in the first direction as the distortion, and the two light emitting elements of each of at least two adjacent light emitting element pairs may be arranged at a wider light emitting element pitch for the adjacent light emitting element pair more distant from the optical axis in the first direction. By employing such constructions, the imaging optical system can efficiently suppress the problem resulting from the distortion thereof to enable good latent image formation to be performed.

The two light emitting elements of each of at least two adjacent light emitting element pairs may be arranged at a wider light emitting element pitch for the adjacent light emitting element pair closer to the center of gravity of the three or more light emitting elements in the first direction. By employing such a construction, the problem resulting from the heat generation of the light emitting elements can be efficiently suppressed to enable good latent image formation to be performed as described above.

The light emitting elements may be organic EL devices. Specifically, in the case where the light emitting elements are organic EL devices, an organic EL material needs to be applied to the substrate on which the light emitting elements are arranged. At this time, the application nonuniformity of the organic EL material is preferably small in order to level the emission characteristics of the respective light emitting elements. In view of this, the two light emitting elements of each of at least two adjacent light emitting element pairs are arranged at the light emitting element pitch different from each other in the embodiment. Therefore, the embodiment has a construction advantageous in applying the organic EL material with small application nonuniformity.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An exposure head comprising:

a substrate that is provided with a first light emitting element, a second light emitting element that is arranged at one side of the first light emitting element in a first direction and a third light emitting element that is arranged at the one side of the second light emitting element in the first direction, the first light emitting element and the second light emitting element being arranged at a first distance from each other in the first direction, the second light emitting element and the third light emitting element being arranged at a second distance, which is different from the first distance, from each other in the first direction; and an imaging optical system that images light from the first, the second and the third light emitting elements, wherein the first distance and the second distance are made different from each other according to a distortion of the imaging optical system in the first direction, the first, the second and the third light emitting elements are arranged at the one side in the first direction with respect to an optical axis of the imaging optical system, the imaging optical system has a first aberration of imaging light more distant from the optical axis in the first direction at an optical magnification with a larger absolute value in the first direction as the distortion in the first direction, and the second distance is shorter than the first distance.

2. An exposure head comprising:

a substrate that is provided with a first light emitting element, a second light emitting element that is arranged at one side of the first light emitting element in a first direction and a third light emitting element that is arranged at the one side of the second light emitting element in the first direction, the first light emitting element and the second light emitting element being arranged at a first distance from each other in the first direction, the second light emitting element and the third light emitting element being arranged at a second distance, which is different from the first distance, from each other in the first direction; and an imaging optical system that images light from the first, the second and the third light emitting elements, wherein the first distance and the second distance are made different from each other according to a distortion of the imaging optical system in the first direction, the first, the second and the third light emitting elements are arranged at the one side in the first direction with respect to an optical axis of the imaging optical system, the imaging optical system has a second aberration of imaging light more distant from the optical axis in the first direction at an optical magnification with a smaller absolute value in the first direction as the distortion in the first direction, and the second distance is longer than the first distance.

3. An exposure head comprising:

a substrate that is provided with a first light emitting element, a second light emitting element that is arranged at one side of the first light emitting element in a first direction and a third light emitting element that is arranged at the one side of the second light emitting element in the first direction the first light emitting element and the second light emitting element being arranged at a first distance from each other in the first direction, the second light emitting element and the third light emitting element being arranged at a second distance, which is different from the first distance, from each other in the first direction; and an imaging optical system that images light from the first, the second and the third light emitting elements, wherein the first distance and the second distance are made different from each other according to a distortion of the imaging optical system in the first direction, the first, the second and the third light emitting elements are arranged at the one side in the first direction with respect to an optical axis of the imaging optical system, the second light emitting element is arranged at a side in a second direction orthogonal to the first direction with respect to the first and the third light emitting elements, the first light emitting element and the second light emitting element are arranged at a third distance from each other in the second direction, and the second light emitting element and the third light emitting element are arranged at a fourth distance, which is different from the third distance, from each other in the second direction.

4. The exposure head according to claim 3, wherein the third distance and the fourth distance are made different from each other according to a distortion of the imaging optical system in the second direction.

5. The exposure head according to claim 4, wherein the imaging optical system has a third aberration of imaging light more distant from the optical axis in the first direction at an optical magnification with a larger absolute value in the second direction as the distortion in the second direction, and the fourth distance is shorter than the third distance.

6. The exposure head according to claim 4, wherein the imaging optical system has a fourth aberration of imaging light more distant from the optical axis in the first direction at an optical magnification with a smaller absolute value in the second direction as the distortion in the second direction, and the fourth distance is longer than the third distance.

* * * * *